US007429094B2

(12) United States Patent
Hamasaki et al.

(10) Patent No.: US 7,429,094 B2
(45) Date of Patent: Sep. 30, 2008

(54) INK-JET RECORDING DEVICE AND DOT-PATTERN RECORDING METHOD

(75) Inventors: Yuji Hamasaki, Kawasaki (JP); Jiro Moriyama, Kawasaki (JP); Hidehiko Kanda, Yokohama (JP); Norihiro Kawatoko, Kawasaki (JP); Toshiyuki Chikuma, Kawasaki (JP); Atsushi Sakamoto, Kawasaki (JP); Aya Hayashi, Sendai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/428,898

(22) Filed: Jul. 6, 2006

(65) Prior Publication Data

US 2007/0008363 A1 Jan. 11, 2007

(30) Foreign Application Priority Data

Jul. 8, 2005 (JP) ..... 2005-199971
Jun. 29, 2006 (JP) ..... 2006-179817

(51) Int. Cl.
*B41J 2/205* (2006.01)

(52) U.S. Cl. ..... 347/41; 347/19

(58) Field of Classification Search ..... 347/41, 347/19, 12, 15, 43
See application file for complete search history.

(56) References Cited

U.S. PATENT DOCUMENTS

| | | | | |
|---|---|---|---|---|
| 5,956,055 | A | 9/1999 | Gibson et al. | |
| 6,902,251 | B2 | 6/2005 | Morikawa et al. | |
| 2005/0134642 | A1 | 6/2005 | Morikawa et al. | |
| 2005/0285898 | A1 * | 12/2005 | Fagan et al. | 347/41 |

FOREIGN PATENT DOCUMENTS

| | | | |
|---|---|---|---|
| JP | 07-040551 | A | 2/1995 |
| JP | 07-309007 | A | 11/1995 |
| JP | 11-240143 | A | 9/1999 |
| JP | 2003-053961 | A | 2/2003 |
| JP | 2004-009489 | A | 1/2004 |

* cited by examiner

*Primary Examiner*—Lamson D. Nguyen
(74) *Attorney, Agent, or Firm*—Canon U.S.A., Inc., IP Division

(57) ABSTRACT

A recording device drives a recording head mounted on a carriage while main-scanning by moving the carriage in a direction generally orthogonal to the sheet-feeding direction of a sheet. The recording device drives a first nozzle of the recording head at an upstream side in the sheet-feeding direction of the sheet to form a first dot pattern while scanning the carriage and drives a second nozzle at a downstream side in the sheet-feeding direction of the sheet to form a second dot pattern. The recording device feeds a region where the first dot pattern is recorded to a position facing the second nozzle. The second dot pattern is recorded in a region where the first dot pattern is not recorded.

20 Claims, 21 Drawing Sheets

(ROW A IN FIG. 7 (1), IDEAL POSITION SHOWN WITH BROKEN LINES)

(ROW A IN FIG. 7 (2), IDEAL POSITION SHOWN WITH BROKEN LINES)

INK-JET RECORDING DEVICE AND DOT-PATTERN RECORDING METHOD

BACKGROUND OF THE INVENTION

1. Field of the Invention

The present invention relates to an ink-jet recording device and a dot-pattern recording method.

2. Description of the Related Art

Heretofore, there have been recording devices for recording an image by forming a dot pattern based on image information on a recording medium such as paper or a plastic thin plate or the like.

Such recording devices employ various types of recording methods such as the ink-jet method, wire-dot method, thermal method, laser beam method or the like, but in recent years, high-speed recording, high image-quality (high resolution), low noise, and so forth have been demanded. As for recording devices corresponding to these demands, there are ink-jet recording devices. Ink-jet recording devices form an image by adhering ink (recording liquid) droplets discharged from the discharge orifices of a recording head to a recording medium.

Also, ink-jet recording devices can perform non-contact recording, and so can record a stable image as to a wide range of a recording medium. Also, with ink-jet recording devices, serial-type ink-jet recording devices mounting a recoding head which reciprocates perpendicular to the transportation direction of a recording medium have been widely known. In the case of serial-type ink-jet recording devices, the size of a recording head can be reduced as compared with line-type ink-jet recording devices. In addition, there are advantages such as being capable of corresponding to the size of various types of a recording medium, facilitating multiple colorizing due to having multiple nozzle rows, facilitating adjustment of speed and recording image quality by the number of times of over-write printing, and so forth. However, on the other hand, with serial printers, in the case of printing vertical linework, the linework for each line printed sometimes causes a leaning linework deviation. This is because in the event that the recording head has not been correctly positioned at a carriage, ink discharge orifices may be disposed leaning from a normal position, and the recording dot row thereof is recorded leaning (e.g., slanted away from the vertical) in the transportation direction of the recording medium. Further, such a recording positional deviation destroys the complementary relation between the respective recording scans in the case of performing multi-pass recording, resulting in deterioration of image quality. Further, with a recording device which performs color printing by disposing such a plurality of heads, and recording a different colored ink at each head, even a small deviation causes irregular color and graininess, resulting in a greatly adverse effect upon an image. Heretofore, with such a serial-type recording device, various types of recording method have been proposed for suppressing an adverse affect upon image quality due to leaning, and improving image quality.

For example, a recording dot row is prevented from leaning (slanting) by improving accuracy regarding a head manufacturing error and a head mounting error as to a recording device. Japanese Patent Laid-Open No. 1995-309007 has proposed an ink-jet printing system for visually reducing a rotational error due to rotation of a head by providing an error correcting circuit for adding offset to a recording image within a nozzle. Japanese Patent Laid-Open No. 1995-40551 has proposed an ink-jet recording device for performing modification of a driving block sequence and modification of a block interval depending on a leaning of a recording head. Japanese Patent Laid-Open No. 1999-240143 has proposed a recording method for determining offset based on the deviation of an impact position in the traversing direction between the nozzle lowermost portion at a first scanning and the nozzle uppermost portion at a second scanning, and shifting a part within the nozzle for the amount of distance depending on the determined offset to correct a head mounting error in the rotational direction at the time of mounting a head. Japanese Patent Laid-Open No. 2004-9489 has proposed an ink-jet recording device which varies data to be assigned to a nozzle depending on the leaning of a head. The above conventional techniques focus on performing preferred control based on assuming that the leaning of a head has been recognized. Incidentally, a method for determining the leaning of a head has been disclosed in Japanese Patent Laid-Open No. 2003-53961. Here, in order to determine the leaning of a printing head as to the sheet-feeding direction, an arrangement for printing a test pattern has been disclosed. First, a part of the printing head at the upstream side in the sheet-feeding direction is moved to print a first pattern while scanning a carriage. Then, a predetermined amount of sheet feeding is performed. Next, a part of the printing head at the downstream side in the sheet-feeding direction, i.e., a part of the printing head on the other end is moved to print a second pattern. Sheet feeding is performed so as to print these patterns in the sheet-feeding direction mutually in an overlapping manner. FIG. 8 illustrates the layouts of the print dots in this overlapped portion. In a state in which the printing head has no leaning, the dots are disposed uniformly. On the contrary, in a state in which the printing head has leaning, the dots are not disposed uniformly. Such a non-uniform layout causes irregularities in density upon an overlapped recording region. A user can visually determine the irregularities in density, and can recognize the leaning of the printing head and the degree thereof.

However, of the above leaning correction methods, with correction using data, the correction resolution and the recording resolution become equal, so the deviation of the recording position at a correction position becomes prominent. Raising recording resolution up to a degree in which the deviation of a recording position is not prominently visible to prevent such a situation means that a greater amount of image data is required to be handled at the main unit, resulting in a factor for causing deterioration of recording speed and increase in the cost of the main unit, which is a problem. Also, raising the correction resolution without changing the amount of image data means that correction using driving the head causes a problem wherein multiple driving signals need to be generated and selected to complicate the configuration, which becomes a factor for increase in cost of the main unit. Specific problems in the conventional techniques will be cited below.

Japanese Patent Laid-Open No. 1995-309007 has proposed the ink-jet printing system for classifying the inside of the printing head into two or more nozzle groups, offsetting the second nozzle group as to the first nozzle group, and recording this to correct an error due to rotation of the head. As for methods for offsetting a nozzle group, "control for shifting a driving signal as to the second nozzle group", and "control for shifting data itself to be sent to the second nozzle group" have been disclosed in the embodiments. However, in the case of the former control for shifting a driving signal, a problem arises in that driving signal propagating lines for the respective nozzle groups are necessary. Additionally, the maximum width which can be shifted is restricted to a zone until the next data signal is input, and so forth. On the other hand, in the case of the latter control for shifting data itself, the shift distance is not restricted, but another problem is caused wherein attempting to perform fine shifting causes resolution to be increased, resulting in increase of the amount of image data. The problems such as described above both lead to complication of the configuration of the recording device and increase of the amount of memory, resulting in factors for increase in cost.

Japanese Patent Laid-Open No. 1995-40551 has disclosed the ink-jet recording device for performing modification of a driving block sequence and modification of a block interval depending on a leaning of a recording head. However, such control using a driving block causes a problem wherein the maximum width which can be shifted is restricted to a zone until the next data signal is input, which can correspond to a certain leaning alone.

Japanese Patent Laid-Open No. 1999-240143 has proposed the following method for correcting an error due to rotation of a head. This method is a method for determining offset based on the deviation of an impact position in the traversing direction between the nozzle lowermost portion at a first scanning and the nozzle uppermost portion at a second scanning, and shifting a part within a nozzle for the amount of distance depending on the determined offset.

Also, Japanese Patent Laid-Open No. 2004-9489 has disclosed an ink-jet recording device which varies data to be assigned to a nozzle depending on the leaning of a head. However, both of Japanese Patent Laid-Open No. 1999-240143 and Japanese Patent Laid-Open No. 2004-9489 realize shifting of a recording dot position by correcting data. Accordingly, when attempting to perform fine offsetting such as described above, there is the need to increase resolution, which causes a problem wherein the amount of image data becomes great.

The above preceding techniques aim at control of the driving timing of the head assuming that there is information regarding the leaning of the head. Accordingly, how to obtain the amount of the leaning of the head has not been disclosed. Japanese Patent Laid-Open No. 1995-309007 has no description how to obtain the leaning of a printing head. Similarly, Japanese Patent Laid-Open No. 1995-40551 has not disclosed a method for obtaining the leaning of a printing head either. Japanese Patent Laid-Open No. 1999-240143 has proposed the recording method for determining offset based on the deviation of an impact position in the traversing direction between the nozzle lowermost portion at a first scanning and the nozzle uppermost portion at a second scanning, and shifting a part within a nozzle for the amount of distance depending on the determined offset. However, a technique for determining the deviation of an impact position in the traverse direction thereof from one dot printed from the respective nozzles at the upper and lower ends has not been described. Even if the deviation of an impact position is determined, it is not easy to determine the deviation from one dot on a recording sheet. Also, it can be conceived to employ an optical sensor for obtaining the deviation of a recording dot, but which leads to increase in cost and complication of the device configuration. Japanese Patent Laid-Open No. 2003-53961 discloses recognizing a leaning of a printing head using a test pattern. However, the conventional technique for visually determining the irregularities of density of a test pattern sometimes has a problem in that irregularities cannot be readily recognized.

SUMMARY OF THE INVENTION

An embodiment of the present invention is directed to a control method for enabling a print position to be adjusted without requiring additional memory and deterioration of printing speed due to increase of image data, and increase in cost due to complication of driving control.

According to an aspect of the present invention, an embodiment is directed to an ink-jet recording device which drives an ink-jet recording head mounted on a carriage and including multiple nozzles, while main-scanning by moving the carriage in a direction generally orthogonal to a sheet-feeding direction of a sheet, so as to record on the sheet. The ink-jet recording device includes a first recording unit configured to drive a first nozzle at an upstream side in the sheet-feeding direction of the sheet to form a first dot pattern while scanning the carriage, and a second recording unit configured to drive a second nozzle at a downstream side of in the sheet-feeding direction of the sheet to form a second dot pattern. The ink-jet recording device further includes a sheet-feeding unit configured to feed a region where the first dot pattern is recorded to a position facing the second nozzle. The first recording unit records the first dot pattern with a predetermined interval in the main-scanning direction, and the second recording unit records the second dot pattern in a region where the first dot pattern is not recorded.

According to another aspect of the present invention, an embodiment is directed to a dot pattern recording method, for driving an ink-jet recording head mounted on a carriage and including multiple nozzles, while main-scanning by moving the carriage in a direction generally orthogonal to a sheet-feeding direction of a sheet. The method includes driving a first nozzle at an upstream side in the sheet-feeding direction of the sheet to form a first dot pattern while scanning the carriage, driving a second nozzle at a downstream side in the sheet-feeding direction of the sheet to form a second dot pattern, and feeding a region where the first dot pattern is recorded to a position facing the second nozzle. The second dot pattern is recorded in a region where the first dot pattern is not recorded.

It is noted that the references to "an" or "one" embodiment of this disclosure are not necessarily directed to the same embodiment, and such references mean at least one.

Further features of the present invention will become apparent from the following description of exemplary embodiments with reference to the attached drawings.

DESCRIPTION OF THE EMBODIMENTS

Embodiments of the present invention enable a print position adjustment pattern having high visibility to be formed without increasing the amount of pattern data for improving visibility, and eliminates the needs to increase the amount of memory for holding image data and the amount of data transfer to a recording device from a host. Accordingly, a low-cost configuration requiring no complex head control mechanism enables positional adjustment of the rotational direction (θ) of a discharge nozzle row of an ink-jet recording head, and further, positional adjustment in the main-scanning (X) direction and positional adjustment in the sub-scanning (Y) direction of the discharge nozzle row. As a result, influence as to an image having a positional deviation in the rotational direction (θ) of the ink discharge nozzle row can be reduced. Further, influence as to an image having a positional deviation in the main-scanning (X) direction, and a positional deviation in the sub-scanning (Y) direction of multiple ink discharge nozzle rows and an ink discharge nozzle row including multiple ink-jet recording heads.

Hereinafter, description will be made regarding an embodiment of the present invention with reference to the drawings. The following embodiment is applicable examples as to an ink-jet recording device.

First, prior to description of the embodiment of the present invention, one example of the basic configuration of an ink-jet recording device to which the embodiment can be applied will be described with reference to FIGS. 2 and 3.

(Basic Configuration Example of Ink-Jet Recording Device)

Figure 2:
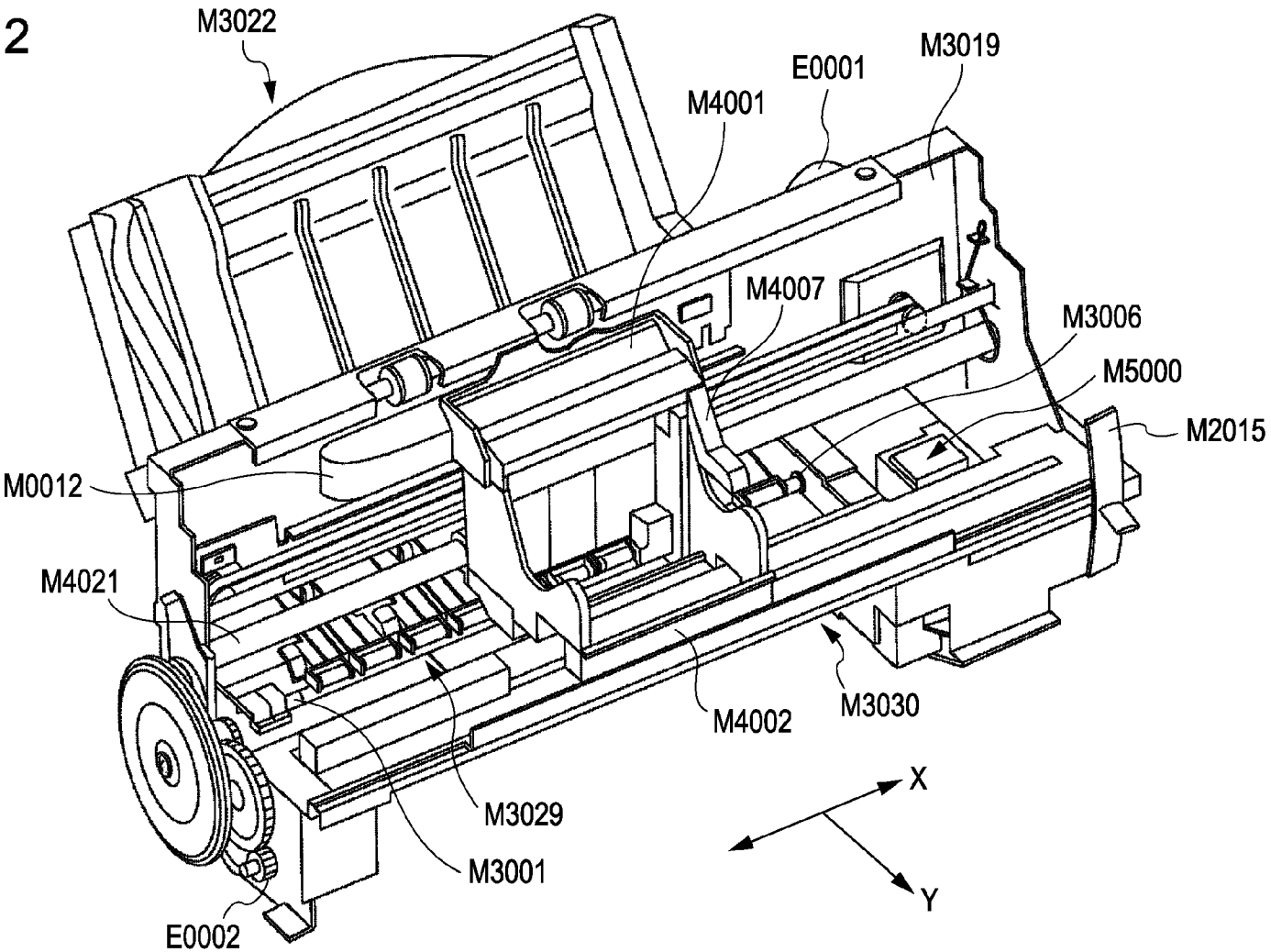
FIG. 2 is a perspective view of principal parts of an ink-jet recording device according to an embodiment of the present invention.
Figure 3:
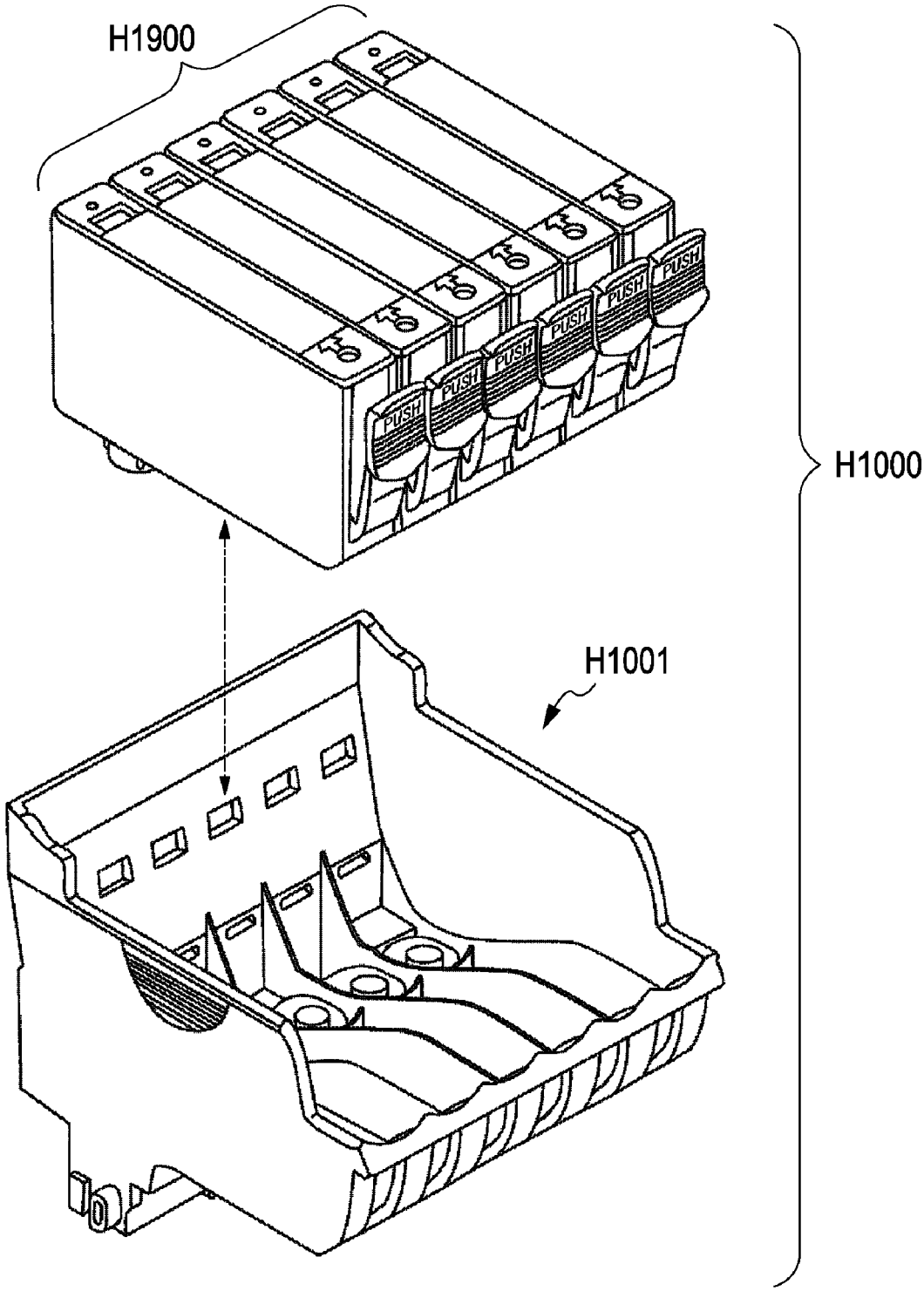
FIG. 3 is a perspective view of a recording head to be employed for the recording device shown in FIG. 2, according to an embodiment of the present invention.

FIGS. 2 and 3 are schematic configuration diagrams of principal portions of an ink-jet recording device to which an embodiment of the present invention can be applied.

In FIG. 2, a chassis M3019 stored within an exterior member of the recording device is made up of multiple plate-shaped metal members having predetermined stiffness, makes up the outline of the recording device, and retains respective recording mechanisms such as the following. An automatic feeding unit M3022 automatically feeds a sheet (recording medium) into a device main unit. A transportation unit M3029 guides the sheet to be transmitted from the automatic feeding unit M3022 one by one to a predetermined recording position, and also guides the sheet to a discharge unit M3030 from the recording position. An arrow Y is the transportation direction (sub-scanning direction) of a sheet. The sheet transported at a recording position is subjected to desired recording by a recording unit. A recovery unit M5000 subjects this recording unit to recovery processing. Reference numeral M2015 denotes an inter-sheets adjustment lever, and M3006 denotes the bearing of an LF roller M3001. With the recording unit, a carriage M4001 is supported movably in the main-scanning direction of an arrow X by a carriage shaft M4021. The carriage M4001 is detachably mounted with an ink-jet recording head H1001 (shown in FIG. 3) which can discharge ink. As illustrated in FIG. 3, the recording head H1001 according to the present example makes up a recording head cartridge H1000 along with ink tanks H1900 for retaining ink. As for the ink tanks H1900, respective color independent ink tanks of, for example, black, light cyan, light magenta, cyan, magenta, and yellow are prepared for enabling color recording with the high image quality of a photographic tone. Each of the ink tanks H1900 is detachably attachable to the recording head H1001. The recording head H1001 obtains a head driving signal necessary for recording via a main unit flexible substrate M0012 from a main substrate E0001. Also, thermal energy to be generated from an electric thermal conversion member may be energy for discharging ink. In this case, film boiling is generated in ink by generation of heat of the electric thermal conversion member, and ink can be discharged from ink discharge orifices by firing energy generated at that time.

The recovery unit M5000 is provided with a cap (not shown) for capping the formation surface of the ink discharge orifices in the recording head H1001. This cap may be connected with a suction pump capable of introducing negative pressure therein. In this case, recovery processing (also referred to as "suction recovery processing") can be performed to keep the excellent ink discharge state of the recording head H1001 by introducing negative pressure into the cap covering the ink discharge orifices of the recording head H1001, and subjecting ink to suction discharge from the ink discharge orifices. Also, recovery processing (also referred to as "discharge recovery processing") can be performed to maintain a proper ink discharge state of the recording head H1001 by discharging ink that is not contributing to recording of an image from the ink discharge orifices toward the inside of the cap. Also, with the carriage M4001, as illustrated in FIG. 2, a carriage cover M4002 is provided for guiding the recording head H1001 to a predetermined mounting position on the carriage M4001. Further, with the carriage M4001, a headset lever M4007 is provided for engaging with the tank holder of the recording head H1001, and setting the recording head H1001 to a predetermined mounting position. The headset lever M4007 is provided so as to turn the headset lever shaft positioned on the upper portion of the carriage M4001. An engagement unit for engaging with the recording head H1001 is provided with a headset plate (not shown) to be subjected to spring pressing. The headset lever M4007 mounts the recording head H1001 on the carriage M4001 while pressing the recording head H1001 by using the spring force thereof.

Figure 4:
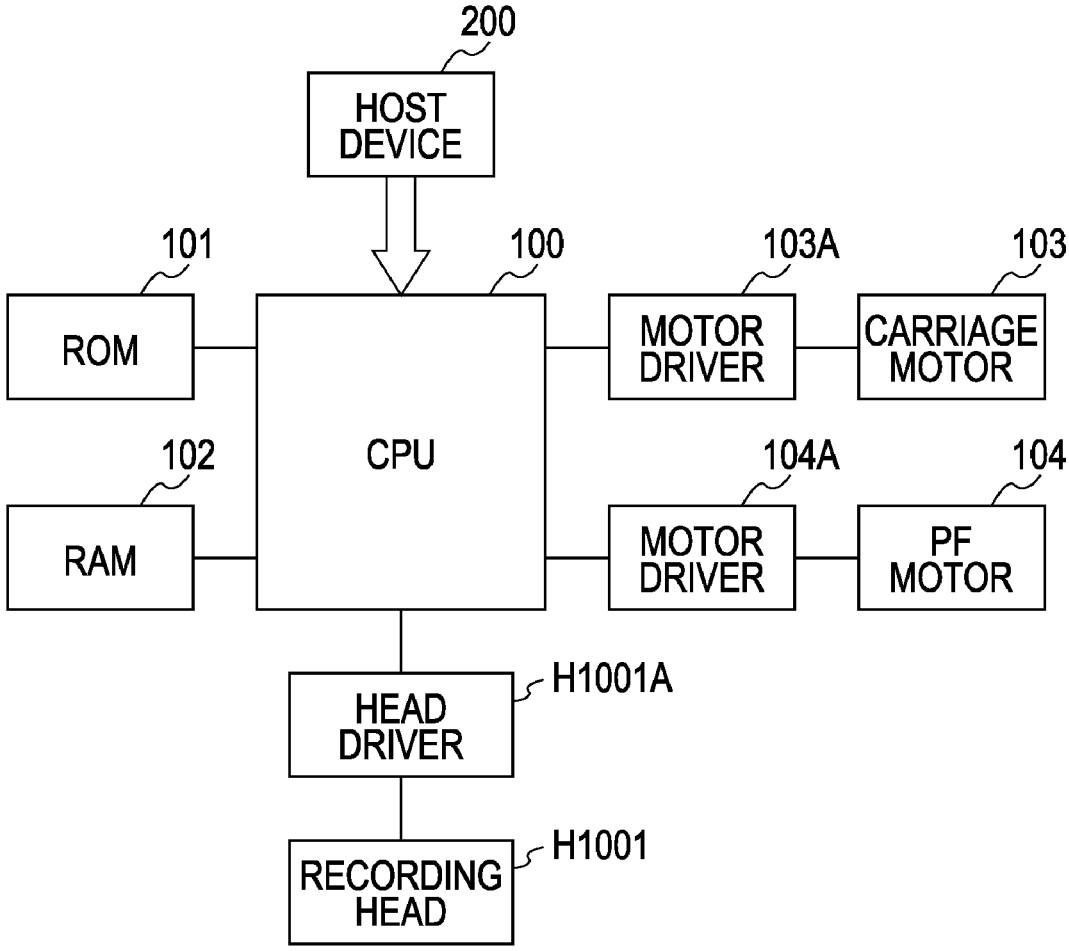
FIG. 4 is a block diagram of a control system in an ink-jet recording device, according to an embodiment of the present invention.

FIG. 4 is a block diagram of a control system in an ink-jet recording device, such as the recording device described with reference to FIGS. 2 and 3, according to an embodiment of the present invention.

In FIG. 4, a CPU 100 executes various operations of the printing device, including control processing according to the present embodiment, data processing, printing control for driving the recording head so as to perform recording based on the processed recording data, and so forth.

ROM 101 stores a program such as a processing sequence of software programs and so forth, and RAM 102 is employed for a work area for executing the processing of software programs. Discharge of ink from the recording head H1001 can be performed by the CPU 100 supplying the driving data (recording data) of the electric thermal conversion member and the like and a driving control signal (heat pulse signal) to a head driver H1001A. The CPU 100 controls a carriage motor 103 for driving the carriage M4001 in the main-scanning direction via a motor driver 103A, and controls a P.F. motor 104 for conveying a sheet in the sub-scanning direction via a motor driver 104A. In the case of performing recording with the ink-jet recording device thus configured, first, recording data transmitted from a host device 200 (see FIG. 4) through an external interface is temporarily stored in a print buffer. Subsequently, the recording head H1001 is moved in the main-scanning direction by a carriage motor 103 along with the carriage M4001. Subsequently, an image is sequentially recorded upon a sheet by repeating recording operation for discharging ink from the recording head H1001, and conveyance operation for conveying a sheet for a predetermined amount in the sub-scanning direction by the P.F. motor 104, based on the recording data.

First Exemplary Embodiment

An embodiment of the present invention will be described in detail below with reference to the drawings.

Figure 1:
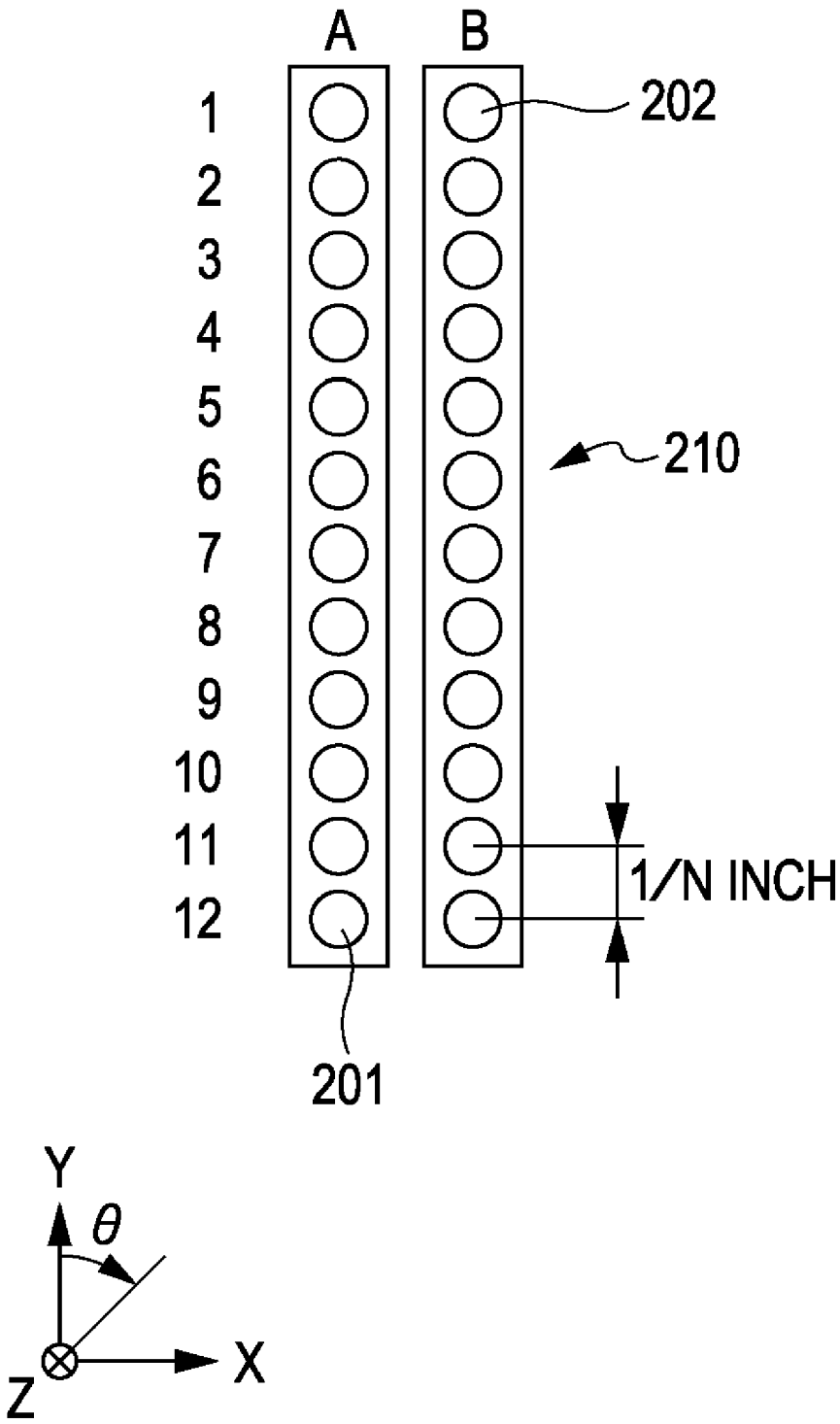
FIG. 1 is a schematic diagram of ink discharge nozzle rows according to an embodiment of the present invention.

FIG. 1 illustrates a schematic diagram of ink discharge nozzle rows included in an ink-jet recording head according to an embodiment of the present invention as viewed from the surface side. In FIG. 1, reference numeral 210 denotes the surface of the ink-jet recording head having an ink discharge nozzle, wherein a row A includes an ink discharge orifices 201 from 1 through 12, and a row B also includes an ink discharge orifices 202 from 1 through 12. The ink discharge orifices of the row A are each positioned at the same positions in the horizontal direction in the corresponding nozzle numbers as the ink discharge orifices of the row B. Also, an arrangement may be made wherein the sizes of the ink discharge droplets of the ink discharge orifices 201 and 202 are the same, or different. Also, the colors of the ink discharge droplets may be the same, or may be different. With the present embodiment, let us say that an arrangement is made so that the amount of discharge between the ink discharge orifices 201 and 202 are equal. Also, let us say that the rows A and B each have a different color. Also, for the sake of facilitating description of the function of print position adjustment, the number of ink discharge nozzles is described as being 1 through 12, but may be greater than 12, and actually, frequently 128 or more. As for the positional components of the ink discharge nozzle rows, let us say that the direction X where the ink-jet recording head moves on the ink-jet recording device is the main-scanning direction, and the direction Y where a recording medium is conveyed is the sub-scanning direction.

The rotational direction θ of the ink-jet recording nozzle rows illustrates the leanings (slanting) of the ink nozzle rows as to the sub-scanning direction, and with the Y illustrated in FIG. 1 as the nozzle row itself, the position of θ illustrated in the drawing may be assumed as the position of an alternate angle. Also, FIG. 1 illustrates the case of the rows A and B being attached on the same ink-jet recording head. The rows A and B are individual ink-jet recording heads, and each of the ink-jet recording heads may be mounted individually on the carriage M4001 on the ink-jet recording device.

Figure 5:
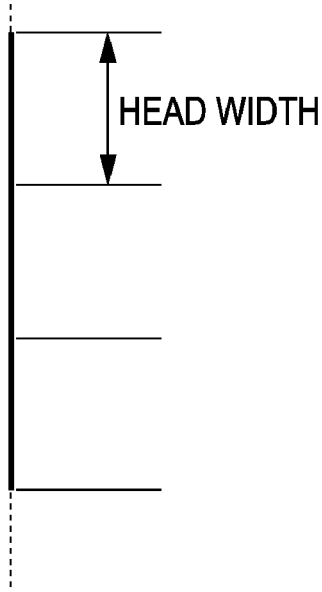
FIG. 5 is a diagram illustrating an example of an ideal vertical linework pattern.

FIG. 1 illustrates a state in which the ink-jet recording head is ideally attached on the ink-jet recording device, and ink dots can be disposed on a recording medium ideally. In this ideal state, an image impression on a recording medium in the case of recording vertical linework are preferred as illustrated in FIG. 5, and the linework intended by a user can be obtained. However, it is cost-wise and technically unrealistic to dispose the ink discharge nozzle to an ideal position as to a recording medium using hardware alone. Also, demand for ink dot impact accuracy on a recording medium has been increased based on reduction of the size of ink dot droplets along with realization of high image quality in recent years.

Figure 7:
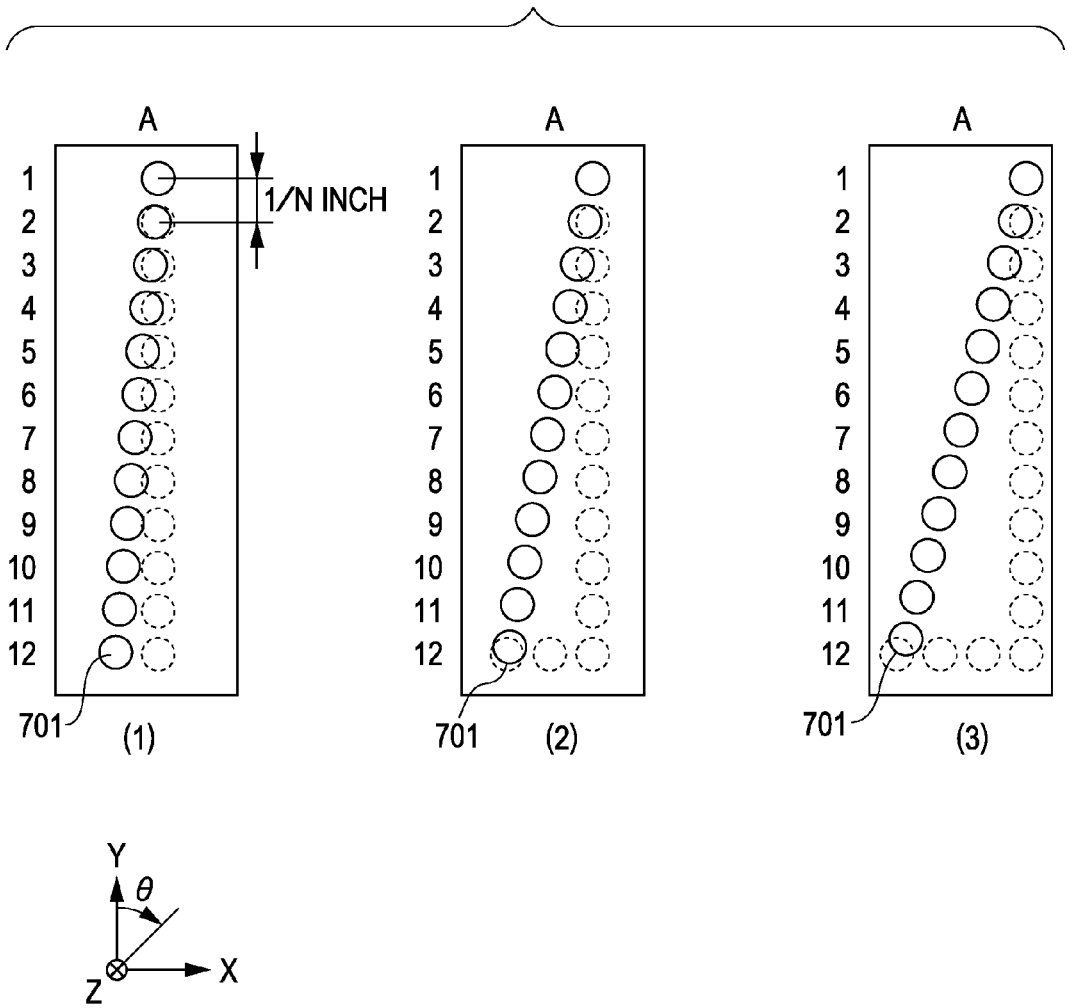
FIG. 7 is a diagram illustrating examples of leaning of nozzle rows.

To illustrate situations where an ink discharge nozzle is not ideally mounted, the ink discharge nozzle may be attached in one of the states shown in FIG. 7.

Figure 6:
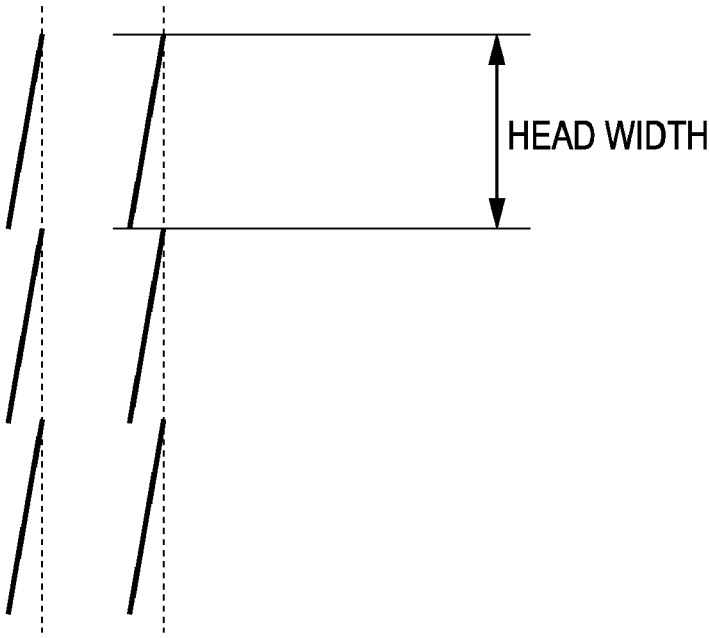
FIG. 6 is a diagram illustrating an example of a vertical linework pattern recorded with a slope due to an improper alignment of a nozzle row.

In the attachment states in FIG. 7, the diagram in the case of recording the above linework pattern on a recording medium without correction in the rotational direction (hereinafter, referred to as θ correction) is illustrated in FIG. 6. Upon implementing one-pass printing without θ correction, the deviation in the X direction is caused at the seams between scanning of linework formed at each scanning, resulting in deterioration of an image.

Figure 8:
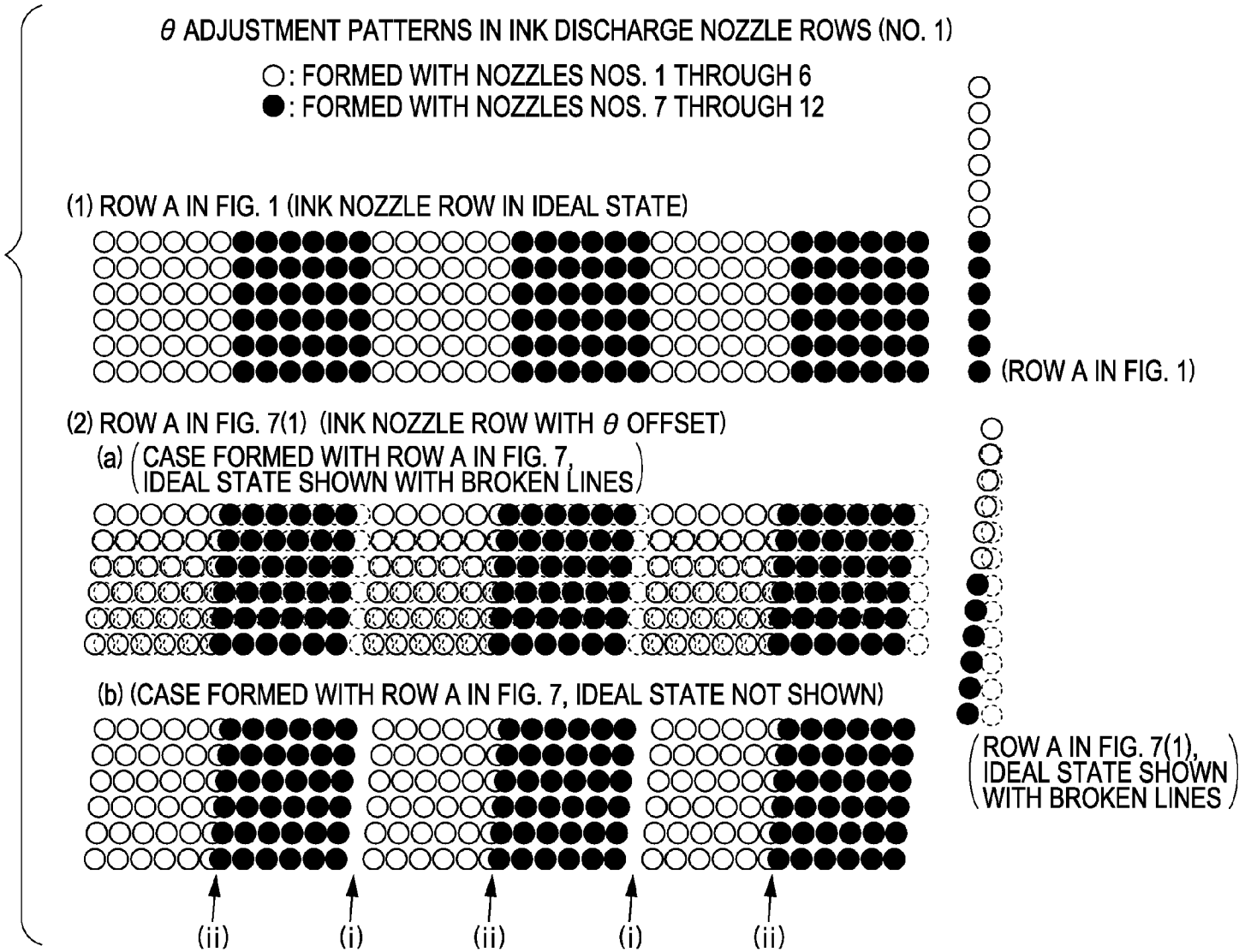
FIG. 8 is one example of a θ registration adjustment pattern according to an embodiment of the present invention.

In order to solve such a situation, the attachments such as illustrated in FIG. 7, or in order to eliminate an ink-jet recording head error, one example of a θ position adjustment pattern illustrated in FIG. 8 is provided. First, a state in which a θ position adjustment pattern is formed using an ink discharge nozzle row in an ideal state is illustrated in (1) in FIG. 8. Next, a state in which a θ position adjustment pattern is formed using an ink discharge nozzle in a state of FIG. 7 under the same ink discharge nozzle driving condition is illustrated in (2) in FIG. 8.

In (1) in FIG. 8, white circles indicate results of forming multiple dots in the direction thereof while scanning the carriage using the nozzles No. 1 through No. 6. With the present example, following six dots being consecutively formed in the main-scanning direction from the recording start position, the next six dots are not formed. Subsequently, six dots are formed in the main-scanning direction using the six nozzles of Nos. 1 through 6 again. This cycle is performed a predetermined number of times. Next, sheet feeding is performed such that the position of the dot recorded with the nozzle No. 1 faces the nozzle No. 7 in the sheet-feeding direction. Subsequently, six dots are formed in the main-scanning direction using the six nozzles of the nozzles Nos. 7 through 12. Recording of the second dot pattern is performed a predetermined number of times in the same way as with the recording to the above-described first dot pattern. The recording operations described above are executed based on printing control under the CPU 100. The black circles in FIG. 8 are results of forming dots using the nozzles Nos. 7 through 12. Thus, it can be understood that the dots to be formed with the nozzles Nos. 7 through 12 are formed so as to have a complementary relation with the dots formed with the nozzles Nos. 1 through 6. This complementary relation is as follows. With ordinary recording, driving is started with the same timing between the nozzles Nos. 1 through 6 and the nozzles Nos. 7 through 12, so a pattern in which dots are overlapped on the same region is recorded. However, with the present example, the nozzles Nos. 7 though 12 are driven by shifting the timing of driving the nozzles Nos. 1 through 6 for the amount of six dots intentionally. Thus, a dot pattern having excellent visibility is formed as compared with a conventional pattern for determining the density irregularities of a dot pattern to determine the leaning (slanting) of a printing head. Description will be made below regarding the dot pattern in the case of having the leaning of the printing head. (1) in FIG. 8 has no image appearance quality problem on the pattern since there is no leaning in the nozzle row as to the rotational direction, and the pattern is formed using the ink-jet recording head in an ideal state.

Next, let us consider the case of forming the same pattern under the same head driving condition as the pattern of (1) in FIG. 8 using the ink-jet recording head in the state of (1) in FIG. 7 with reference to (2) in FIG. 8. As illustrated in (2)(a) in FIG. 8, with the group of the nozzles Nos. 1 through 6, the nozzle No. 6 ultimately causes a ½-pixel deviation as to the ideal position, and with the group of the nozzles Nos. 7 through 12, the nozzle No. 12 ultimately causes a one-pixel deviation as to the ideal position. According to these deviations, with the θ position adjustment pattern, a column of ½ pixel where dots are not disposed such as shown in the (i) portion in (2)(b) in FIG. 8 occurs, which generates a white stripe visually. Also, with the (ii) portion, ink dots are overlapped for the amount of ½ pixel, which generates a black stripe visually.

Figure 9:
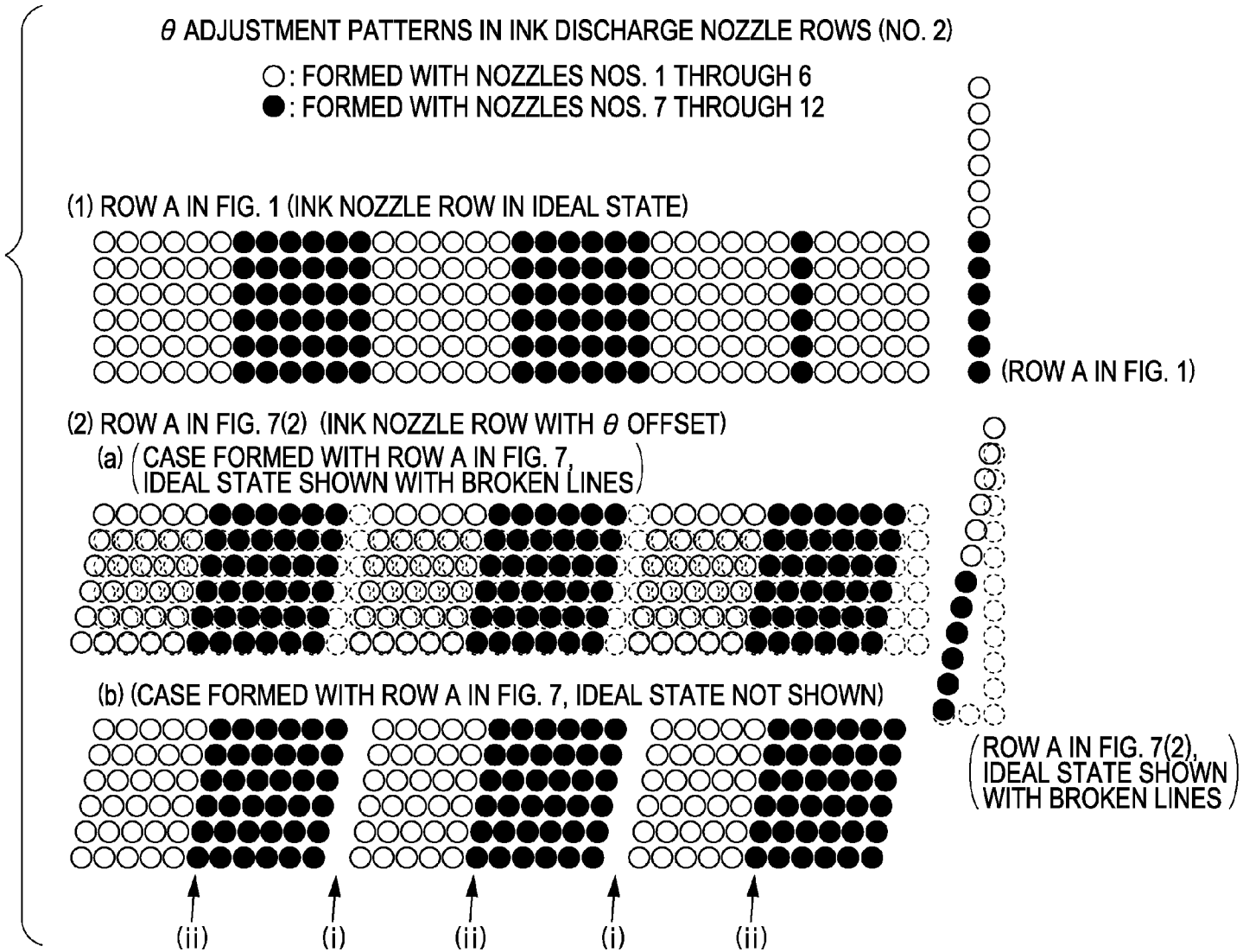
FIG. 9 is another example of a θ registration adjustment pattern according to an embodiment of the present invention.

In (1) in FIG. 9, white circles indicate results of forming multiple dots in the direction thereof while scanning the carriage using the nozzles Nos. 1 through 6. Even with the present example, the θ position adjustment pattern is formed in the same way as illustrated in FIG. 8. (1) in FIG. 9 has no image appearance quality problem on the pattern since there is no leaning in the nozzle row as to the rotational direction, and the pattern is formed using the ink-jet recording head in an ideal state.

Next, let us consider the case of forming the same pattern under the same head driving condition as the pattern of (1) in FIG. 9 is formed using the ink-jet recording head in the state of (2) in FIG. 7 with reference to (2) in FIG. 9. As illustrated in (2)(a) in FIG. 9, with the group of the nozzles Nos. 1 through 6, the nozzle No. 6 ultimately causes a one-pixel deviation as to the ideal position, and with the group of the nozzles Nos. 7 through 12, the nozzle No. 12 ultimately causes a two-pixel deviation as to the ideal position. According to these deviations, with the θ position adjustment pattern, a column of one pixel where dots are not disposed such as shown in the (i) portions in (2)(b) in FIG. 9 occurs, which generates a white stripe visually. Also, with the (ii) portions, ink dots are overlapped for the amount of one pixel, which generates a black stripe visually.

The dot pattern according to the present application may be formed with outward and homeward scanning. For example, an arrangement may be made wherein the dot pattern by driving the nozzles Nos. 1 through 6 are formed with outward scanning, and the dot pattern by driving the nozzles Nos. 7 through 12 are formed with homeward scanning. Also, the contrary thereof can be also realized. However, in order to maintain the appearance quality of the dot patterns, both of the patterns can be formed with outward or homeward scanning alone. This is because the accuracy at the time of driving a carriage operation mechanism is high with one-way scanning as compared with both-way scanning.

Methods for reducing these deviations will be described with reference to FIG. 10.

Figure 10D:
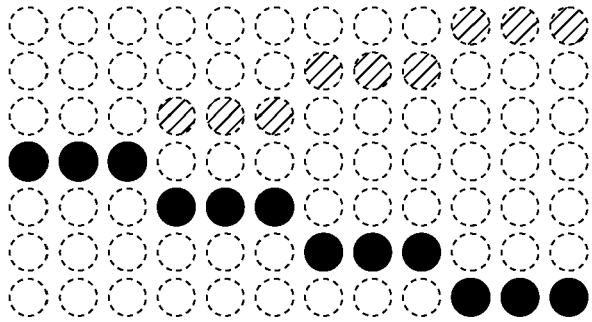
FIGS. 10A-10D are examples of shift images of ink dots to be employed to correct various deviations.
Figure 10C:
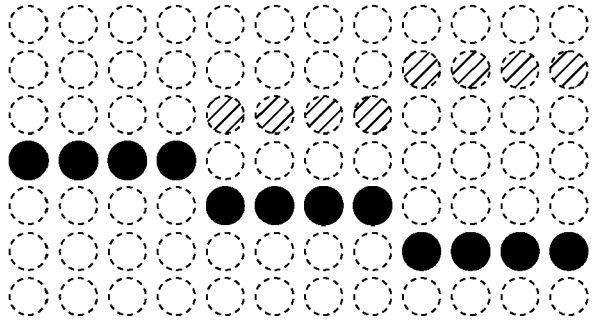
Figure 10B:
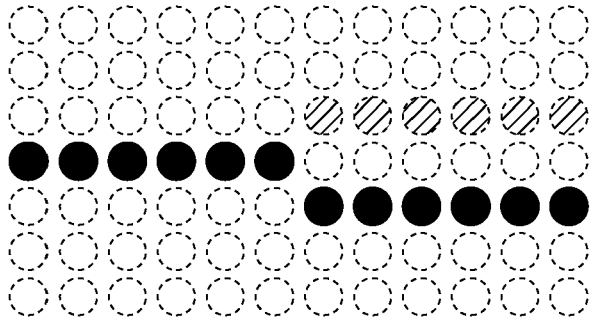
Figure 10A:
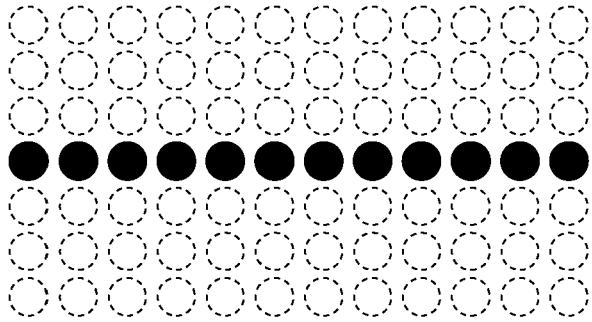
Figure 11:
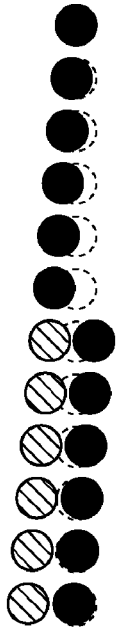
FIG. 11 is a diagram relating to the correction of ink dots to be employed in the case of a θ deviation causing one pixel deviation in the X direction in a nozzle row according to an embodiment of the present invention.

Examples thereof are illustrated in FIGS. 10A through 10D. Printing is performed by shifting the ink dots into any one of FIGS. 10A through 10D for the sake of corresponding to a θ deviation. FIG. 10A shows a case in which the ink discharge nozzle row is in an ideal state, so there is no need to shift the ink dots. FIG. 10B shows a shift image of the ink dots in the case of a θ deviation causing a one-pixel deviation in the X direction with the ink discharge nozzle row, and can be employed in the case of correcting the row A in (1) in FIG. 7. A result of shifting the ink dots based on FIG. 10B is illustrated in FIG. 11. The nozzles Nos. 7 through 12 in a state having no θ adjustment are indicated by vertical hatchings, and a result of shifting the ink dots based on FIG. 10B is indicated by black circles. As a result, as illustrated in FIG. 11, in the event that a θ leaning (slanting) is one pixel in a nozzle row, the problem cannot be eliminated, and accordingly, it can be understood that θ correction has an advantage in the case of a deviation of one pixel or more.

However, in the event of having a dot allocation method less than the minimum resolution in general printing, θ adjustment exceeding pixel increments and print data increments can be performed.

Figure 12:
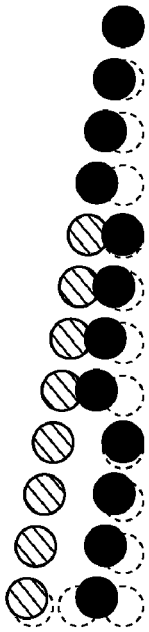
FIG. 12 is a diagram relating to the correction of ink dots to be employed in the case of a θ deviation causing two pixel deviations in the X direction in a nozzle row according to an embodiment of the present invention.

Next, FIG. 10C is a shift image of the ink dots to be employed in the case of a θ deviation causing a two-pixel deviation in the X direction with the ink discharge nozzle row, and can be employed in the case of correcting the row A in (2) in FIG. 7. A result of shifting the ink dots based on FIG. 10C is illustrated in FIG. 12. The nozzles Nos. 5 through 12 in a state having no θ adjustment are illustrated with vertical hatchings, and a result of shifting the ink dots based on FIG. 10C is illustrated with black circles. As a result, a two-pixel deviation in the X direction as the upper end and lower end of the ink discharge nozzle row is reduced to a ½-pixel deviation. The above can be also applied to FIG. 10D. Thus, description has been made regarding up to a 4-division, three-pixel deviation in FIG. 10D, but this advantage is not diminished even in the event that a pixel deviation exceeds three pixels, and the number of divisions exceeds 4-division depending on the number of ink discharge nozzles, ink discharge nozzle driving condition, and so forth.

Figure 13:
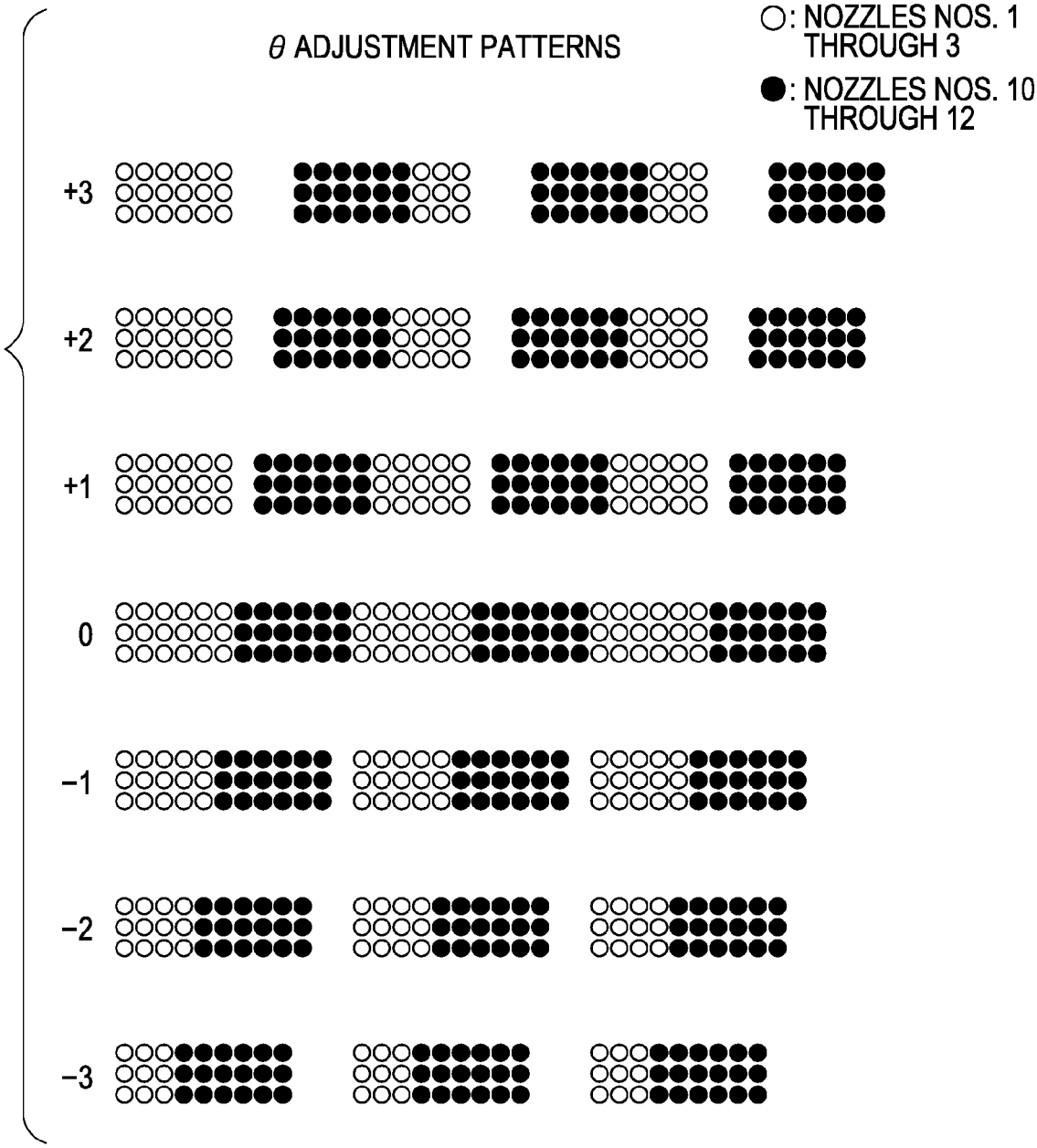
FIG. 13 is a first example of a preferred θ registration adjustment pattern according to an embodiment of the present invention.

Accordingly, the θ position adjustment pattern illustrated in FIG. 8 is sequentially formed by shifting the ink dots illustrated in FIGS. 10A through 10D. Thus, if the amount of deviation of any of FIGS. 10A through 10D is employed, it is apparent whether or not the most appropriate for the θ correction of the ink-jet recording head (ink discharge nozzle rows) at that time can be confirmed with excellent visibility (recognition). FIG. 13 illustrates the θ position adjustment pattern according to an embodiment of the present invention. With this pattern, as a correction value depending on the degree of a dot deviation, a numeric value showing an index, i.e., a value from −3 through +3 is recorded along with the pattern. In the event of printing the θ adjustment pattern using the ink discharge nozzle in an ideal state, 0 in the drawing has the least stripes, it can be determined that the levels in white stripes and black stripes are deteriorated by shifting the ink dot position from +1 to +2, from −1 to −2, and the 0 level is the most appropriate.

The ink discharge nozzles at this time may be all of the general ink discharge nozzles, or may be all of the nozzles excluding the outermost ink discharge nozzles. Also, nozzles which are continuous two dots or more may be employed. Further, nozzles which are discontinuous two dots or more may be employed. Also, a continuous nozzle group may be both ends, or may be a middle portion.

Figure 14:
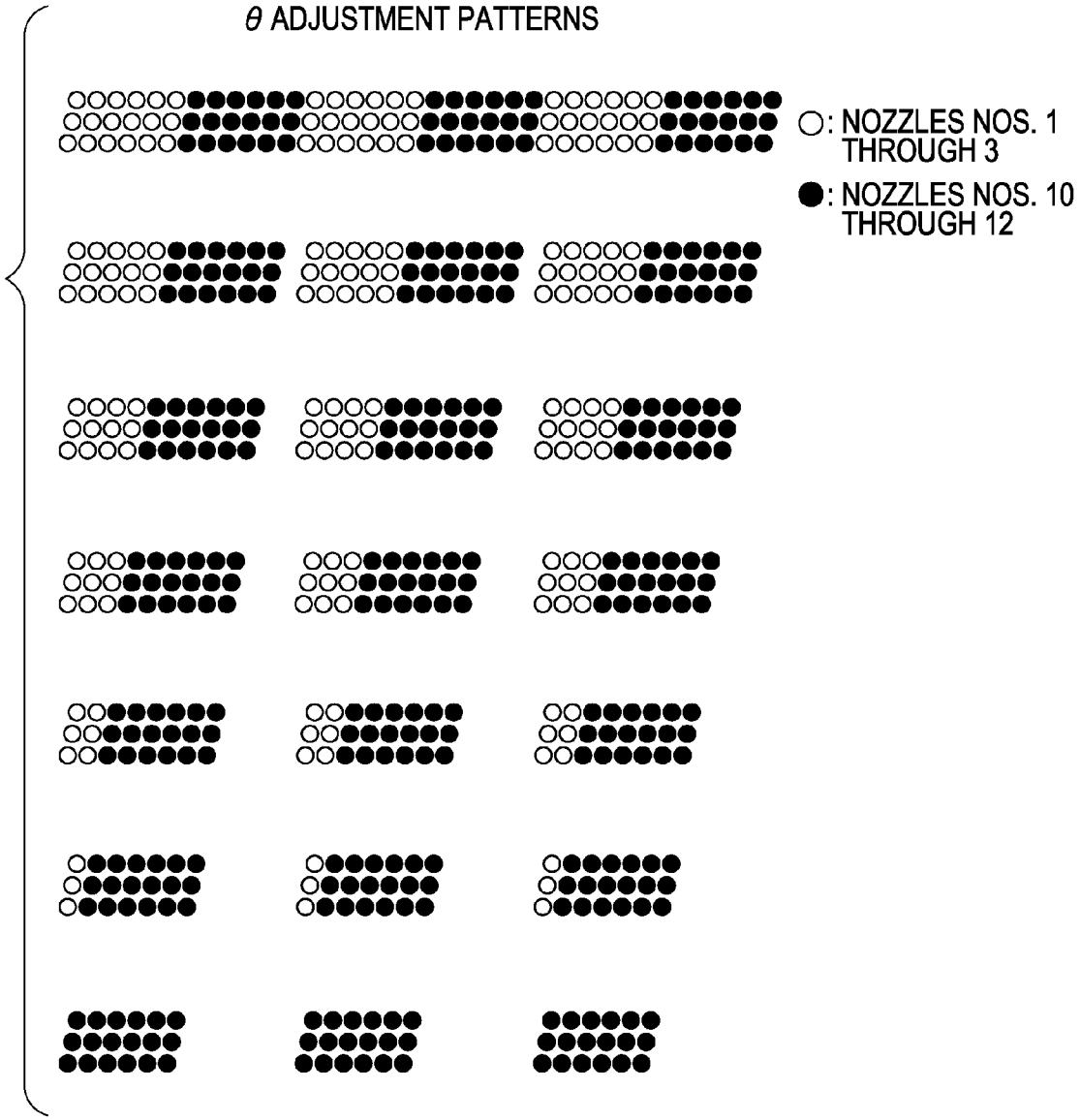
FIG. 14 is a second example of a preferred θ registration adjustment pattern according to an embodiment of the present invention.

Next, FIG. 14 illustrates the θ position adjustment pattern in the case of forming the same pattern as FIG. 13 using the ink discharge nozzle in the state illustrated in (3) in FIG. 7. As illustrated in (3) in FIG. 7, a three-pixel deviation ultimately occurs between the nozzles Nos. 1 and 12, so +3 in the drawing has the least stripes. It can be determined that the levels of white stripes and black stripes are deteriorated sequentially by shifting the ink dot position from +2, +1, 0 to −1, −2, and −3, and the +3 level is the most appropriate.

Also, with the above θ registration adjustment pattern, the ink discharge nozzles having the same driving block and the same driving sequence within the ink discharge nozzle row A may correspond to each other. For example, in FIG. 13, let us say that the nozzles Nos. 1 and 10 having the same position in the horizontal direction are set to the same driving block, and the nozzles Nos. 2 and 11 are set to the same driving block, and the nozzles Nos. 3 and 12 are set to the same driving block. The positional deviation of the ink dots by the driving sequence of the ink discharge nozzles can be eliminated by employing this configuration.

Also, with the above embodiment, the nozzles Nos. 1 and 12, which are the outermost nozzles, are employed, but with the outermost portions of the ink discharge nozzle rows, ink discharge malfunction such as ink color mixture, ink non-discharge, or the like readily occurs as to the other nozzles. Accordingly, the above advantage is not diminished even if the θ position adjustment pattern illustrated in FIG. 13 is formed using the nozzles Nos. 2 through 4 and the nozzles Nos. 9 through 11.

Figure 15:
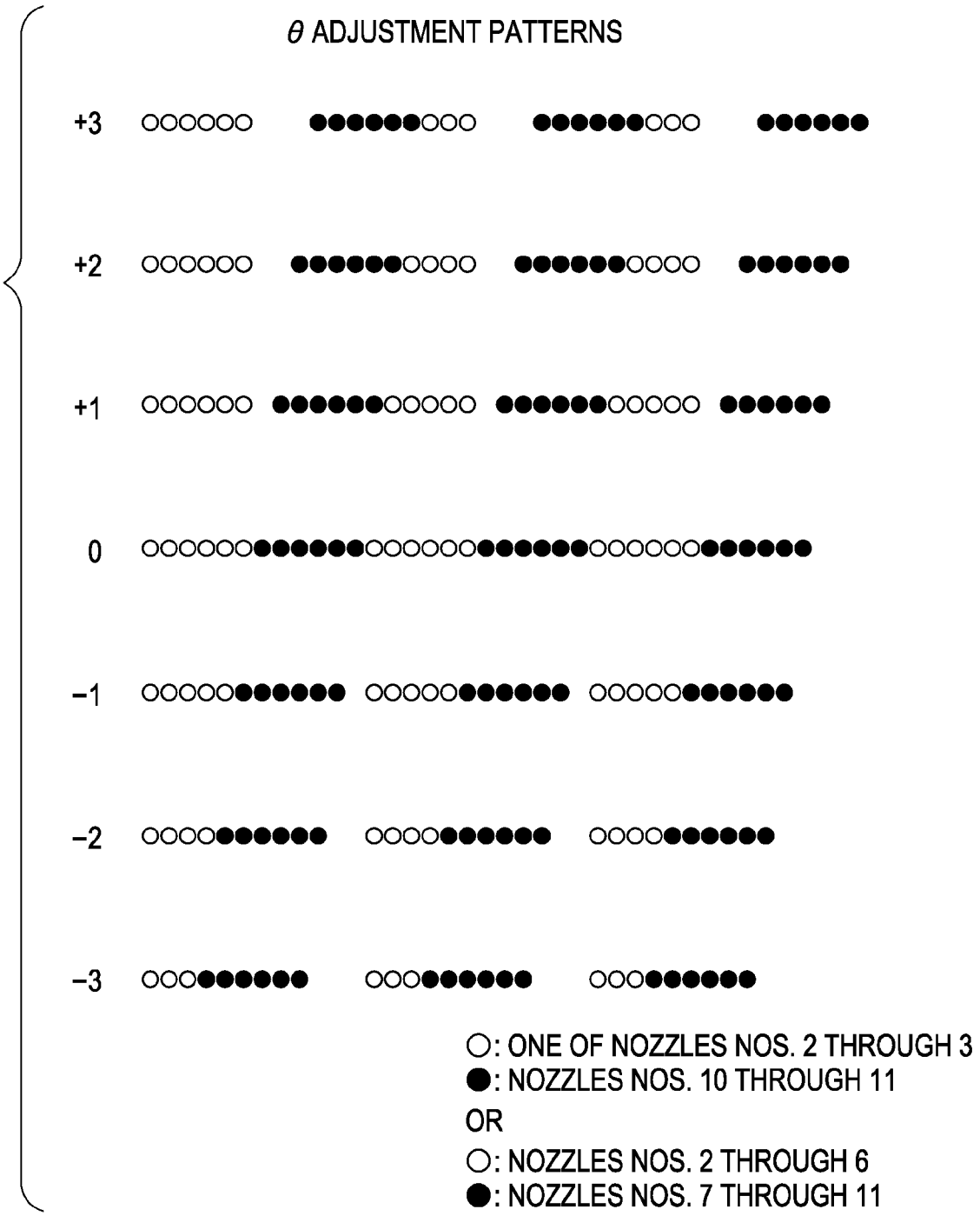
FIG. 15 is a third example of a preferred θ registration adjustment pattern according to an embodiment of the present invention.
Figure 16:
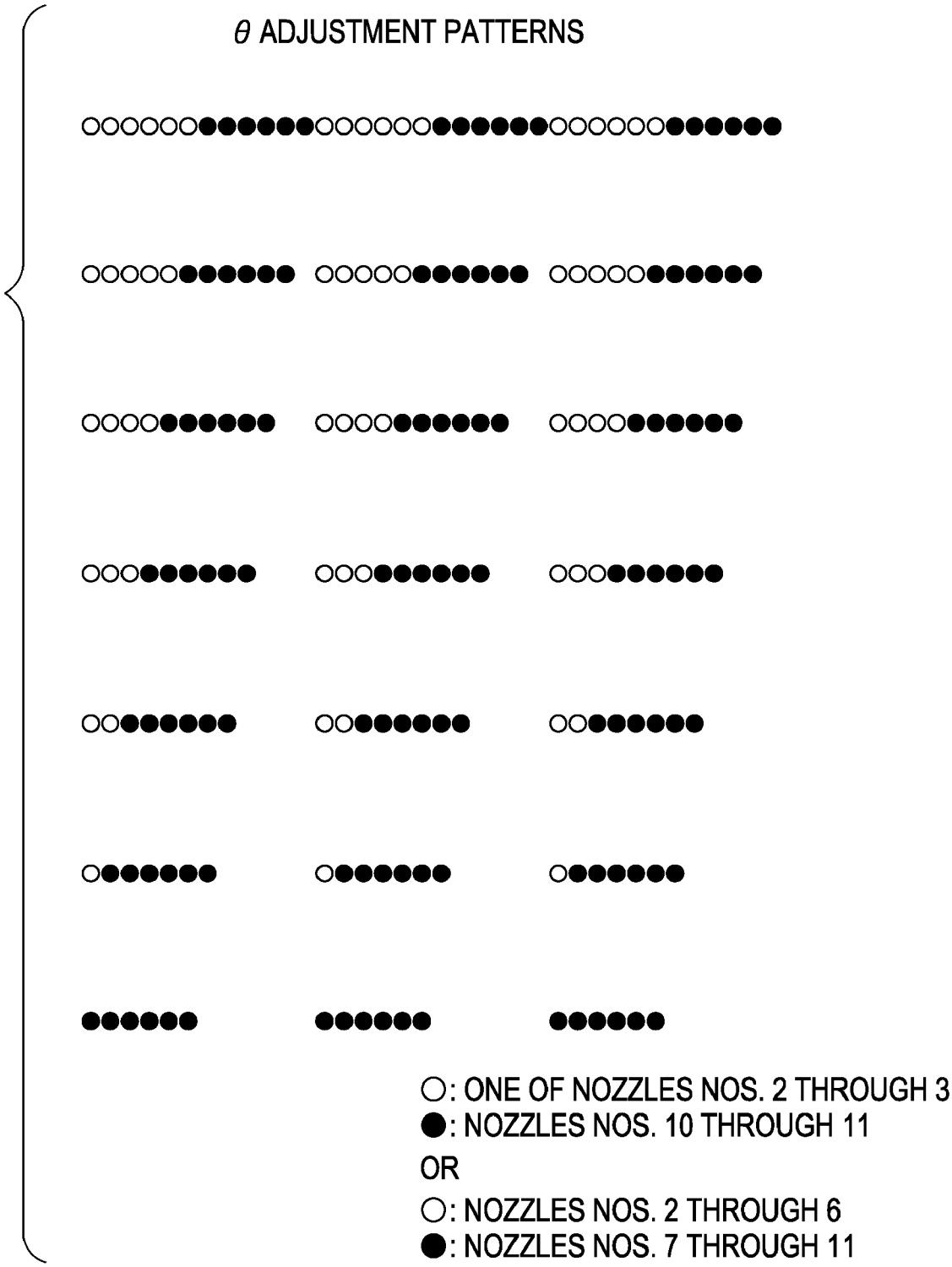
FIG. 16 is a fourth example of a preferred θ registration adjustment pattern according to an embodiment of the present invention.

Further, the above advantage is not diminished even if the θ registration adjustment pattern is formed using a certain nozzle of the ink discharge nozzle rows as illustrated in FIGS. 15 and 16.

Figure 19:
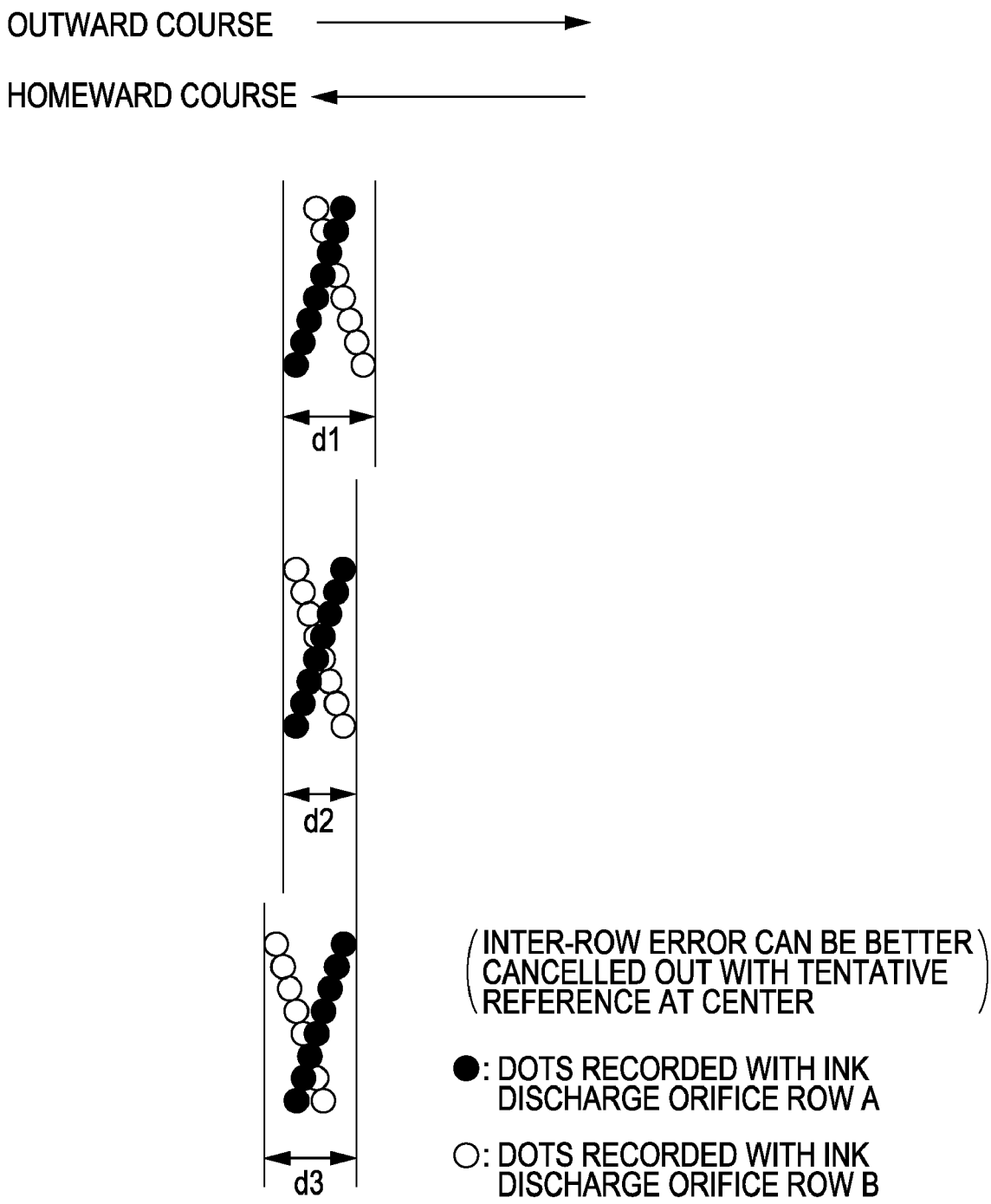
FIG. 19 is one example of X registration adjustment according to an embodiment of the present invention.

With the above θ registration adjustment, the offset value thereof is determined as to the ink discharge nozzle serving as the reference of the respective ink discharge nozzle rows. The reference nozzle may be No. 1, or may be No. 12, and upon the reference nozzle being set to No. 6 or No. 7, approximately one half of the minimum adjustment value of the respective ink discharge nozzle rows can be cancelled out at the time of the following X registration adjustment, as illustrated in FIG. 19. In accordance with an embodiment of the present invention, all of the necessary ink discharge nozzle rows are subjected to the θ position adjustment pattern using the above technique, a θ error is removed, following which the above discharge nozzles are subjected to X registration adjustment and Y registration adjustment. At this time, the sequence between X registration adjustment and Y registration adjustment may be in random order. Also, the θ position adjustment may be performed for each heater board associated with an ink discharge nozzle row, or for each ink-jet recording head.

Figure 17:
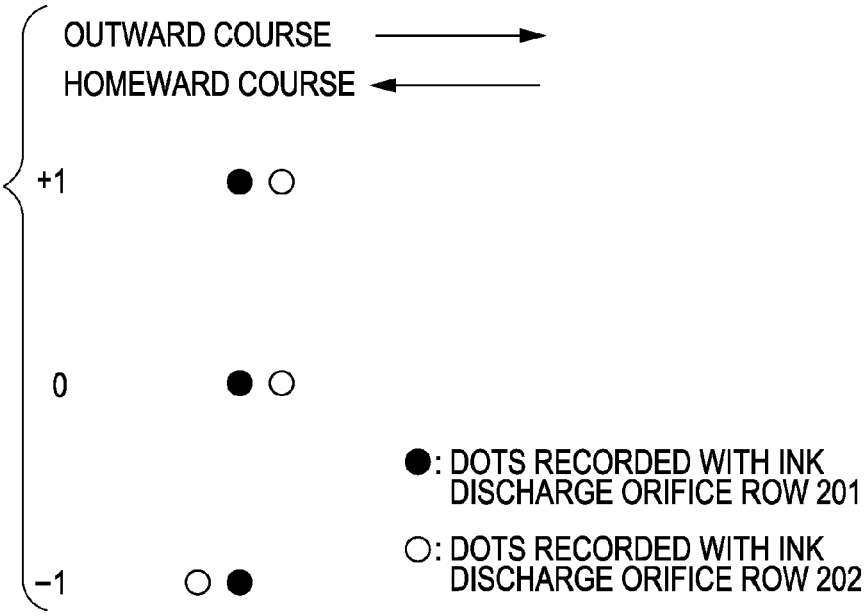
FIG. 17 is a diagram recording an X registration adjustment pattern using a certain nozzle according to an embodiment of the present invention.

The adjustment in the main-scanning direction (X) is performed with the pattern illustrated in FIG. 17. In FIG. 17, a portion where the one dot of the group 201 and the one dot of the group 202 are overlapped can be recognized by sequentially shifting and forming the ink dot positions to the same positions in the horizontal direction using an arbitrary nozzle of the respective ink discharge nozzle rows.

This nozzle selection method may be the same technique as that at the time of the above θ adjustment.

Figure 18:
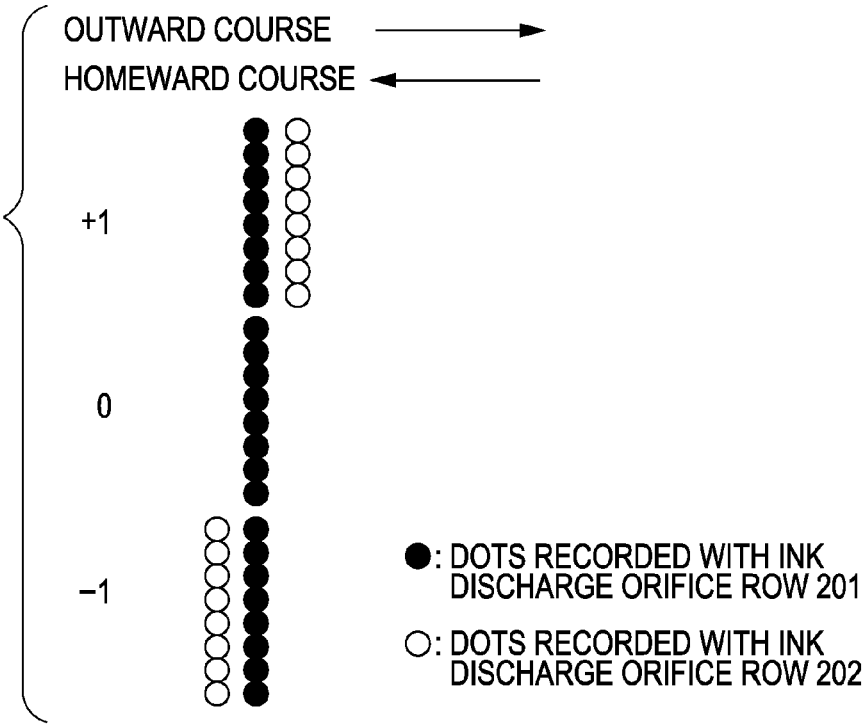
FIG. 18 is a diagram recording an X registration adjustment pattern using all of the certain nozzle rows according to an embodiment of the present invention.

Next, FIG. 18 illustrates a case in which an X registration adjustment pattern is formed using the same technique and same type of continuous ink discharge as those at the time of the θ registration adjustment. The advantage thereof is not diminished even in the event of employing this pattern.

With the above X registration adjustment, the ink discharge nozzles to be employed may be all of the general ink discharge nozzles, or may be all of the nozzles excluding the outermost ink discharge nozzles. Also, nozzles which are continuous two dots or more may be employed. Further, nozzles which are discontinuous two dots or more may be employed. Also, a continuous nozzle group may be both ends, or may be a middle portion. Also, with the above X registration adjustment pattern, the ink discharge nozzles having the same driving block and the same driving sequence within the ink discharge nozzle rows A and B may correspond to each other. With the above X registration adjustment pattern, let us say that the nozzles Nos. 1 and 10 having the same position in the horizontal direction are set to the same driving block, and the nozzles Nos. 2 and 11 are set to the same driving block, and the nozzles Nos. 3 and 12 are set to the same driving block. The positional deviation of the ink dots by the driving sequence of the ink discharge nozzles can be eliminated by employing this configuration.

Also, with the above embodiment, the nozzles Nos. 1 and 12, which are the outermost nozzles, are employed, but with the outermost portions of the ink discharge nozzle rows, ink discharge malfunction such as ink color mixture, ink non-discharge, or the like readily occurs as to the other nozzles, and accordingly, the nozzles Nos. 2 through 4 and Nos. 9 through 11 may be employed.

Figure 27:
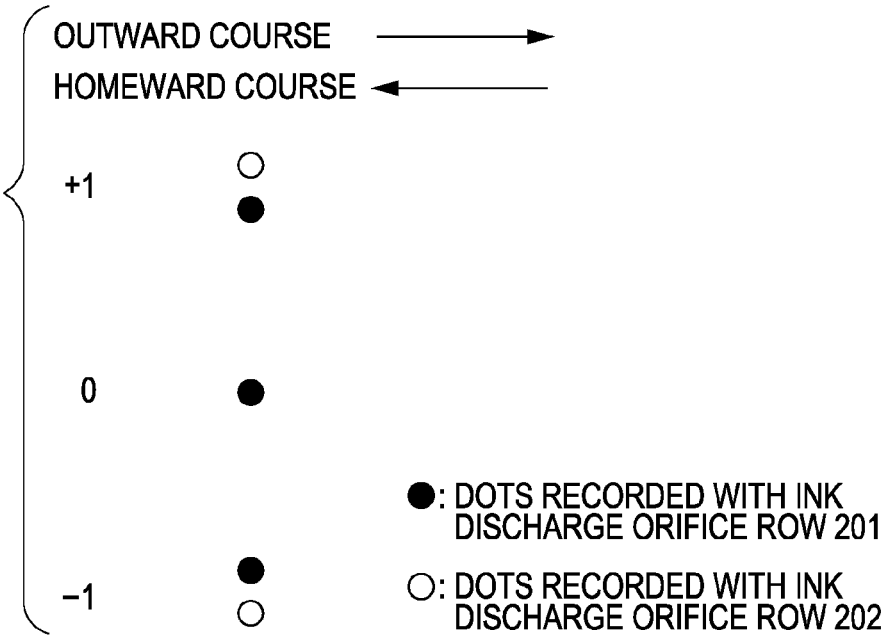
FIG. 27 is a diagram recording a Y registration adjustment pattern using a certain nozzle according to an embodiment of the present invention.

Next, the adjustment in the sub-scanning direction (Y) is performed with the pattern illustrated in FIG. 27. In FIG. 27, a portion where the one dot of the group 201 and the one dot of the group 202 are overlapped can be recognized by sequentially shifting and forming the ink dot positions of the same positions of the respective ink discharge nozzle rows to the same positions in the sub-scanning direction using an arbitrary nozzle of the respective ink discharge nozzle rows. This nozzle selection method may be the same technique as that at the time of the above θ adjustment.

Figure 28:
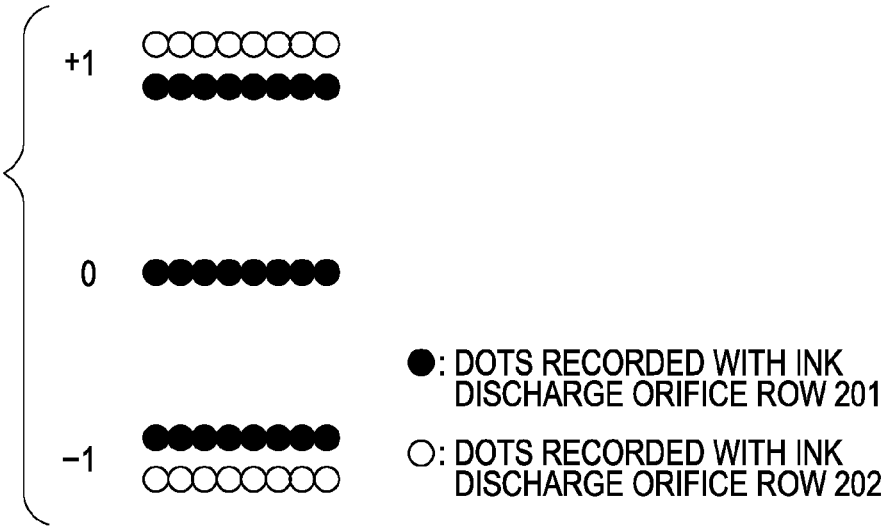
FIG. 28 is a diagram recording a Y registration adjustment pattern using all of the certain nozzle rows according to an embodiment of the present invention.

Next, FIG. 28 illustrates a case in which a Y registration adjustment pattern is formed using the same technique and same type of continuous ink discharge as those at the time of the θ registration adjustment. The advantage thereof is not diminished even in the event of employing this pattern.

With the above Y registration adjustment, the ink discharge nozzles to be employed may be all of the general ink discharge nozzles, or may be all of the nozzles excluding the outermost ink discharge nozzles. Also, nozzles which are continuous two dots or more may be employed. Further, nozzles which are discontinuous two dots or more may be employed. Also, a continuous nozzle group may be both ends, or may be a middle portion. Also, with the above Y registration adjustment pattern, the ink discharge nozzles having the same driving block and the same driving sequence within the ink discharge nozzle rows A and B may be corresponded to each other. With the above Y registration adjustment, let us say that the nozzles Nos. 1 and 10 having the same position in the horizontal direction are set to the same driving block, and the nozzles Nos. 2 and 11 are set to the same driving block, and the nozzles Nos. 3 and 12 are set to the same driving block. The positional deviation of the ink dots by the driving sequence of the ink discharge nozzles can be eliminated by employing this configuration.

Also, with the above embodiment, the nozzles Nos. 1 and 12, which are the outermost nozzles, are employed, but with the outermost portions of the ink discharge nozzle rows, ink discharge malfunction such as ink color mixture, ink non-discharge, or the like readily occurs as to the other nozzles, and accordingly, the nozzles Nos. 2 through 4 and Nos. 9 through 11 may be employed.

Figure 20:
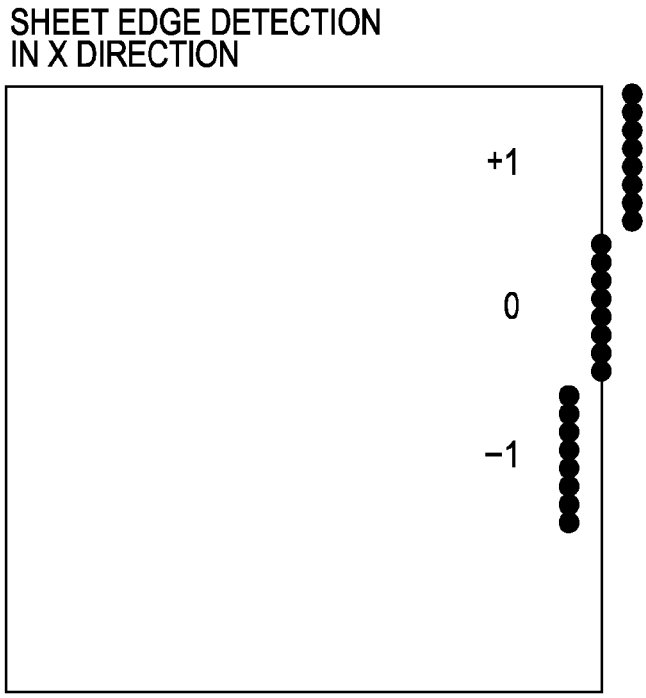
FIG. 20 is a diagram illustrating the positional relation between a recording medium and an X registration adjustment pattern according to an embodiment of the present invention.

Next, description will be made regarding patterns for detecting the position of a recording medium and the position in the main-scanning direction of an ink discharge nozzle row with reference to FIG. 20. With the level +1 which forms ink dots straddling from the outside to the inside of a recording medium, ink dots are not formed on a recording medium, and accordingly, the level +1 is not selected. Next, with the level −1, space is formed between ink dots and the end portion of a recording medium. Accordingly, dots in the level 0 can be selected. The positions of the end portion of a recording medium and ink discharge nozzles are detected with this pattern, and offset is determined as to the reference nozzle of the ink discharge nozzle rows. This offset value may be determined as to each reference nozzle of the respective ink discharge nozzle rows, or may be determined as to one tentative reference nozzle of the ink discharge nozzle rows and ink-jet recording head.

Figure 21:
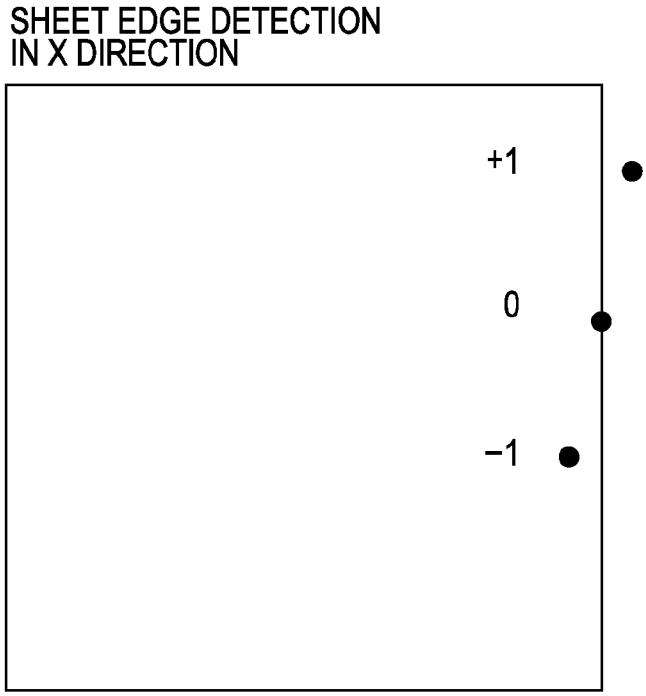
FIG. 21 is a second diagram illustrating the positional relation between a recording medium and an X registration adjustment pattern according to an embodiment of the present invention.
Figure 22:
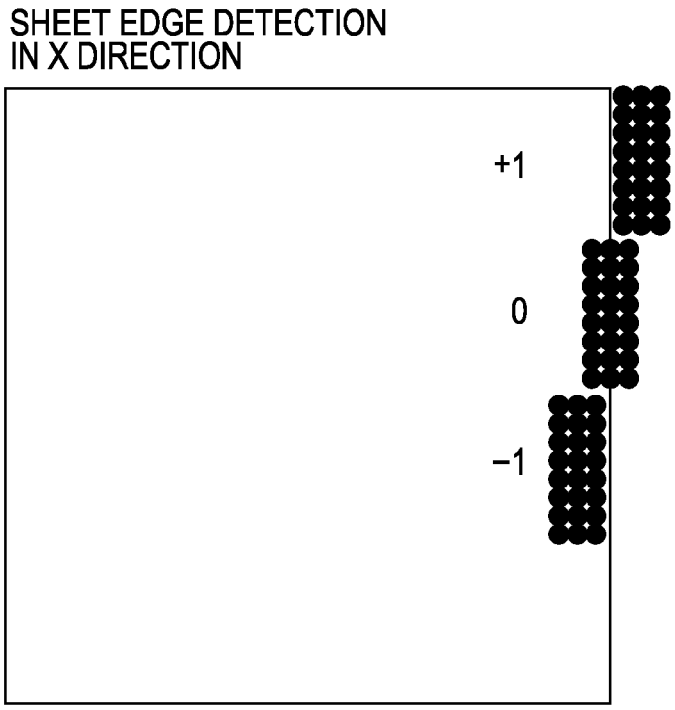
FIG. 22 is a third diagram illustrating the positional relation between a recording medium and an X registration adjustment pattern according to an embodiment of the present invention.

The mode in FIG. 21 may be employed, or the mode in FIG. 22 may be employed.

With the above recording medium and X registration adjustment, the ink discharge nozzles to be employed may be all of the general ink discharge nozzles, or may be all of the nozzles excluding the outermost ink discharge nozzles. Also, nozzles which are continuous two dots or more may be employed. Further, nozzles which are discontinuous two dots or more may be employed. Also, a continuous nozzle group may be both ends, or may be a middle portion. Also, with the above recording medium and X registration adjustment pattern, the ink discharge nozzles having the same driving block and the same driving sequence within the ink discharge nozzle rows A and B may be corresponded to each other. For example, in FIGS. 20, 21, and 22, let us say that the nozzles Nos. 1 and 10 having the same position in the horizontal direction are set to the same driving block, and the nozzles Nos. 2 and 11 are set to the same driving block, and the nozzles Nos. 3 and 12 are set to the same driving block. The positional deviation of the ink dots by the driving sequence of the ink discharge nozzles can be eliminated by employing this configuration.

Also, with the above embodiment, the nozzles Nos. 1 and 12, which are the outermost nozzles, are employed, but with the outermost portions of the ink discharge nozzle rows, ink discharge malfunction such as ink color mixture, ink non-discharge, or the like readily occurs as to the other nozzles, and accordingly, the nozzles Nos. 2 through 4 and Nos. 9 through 11 may be employed.

Figure 23:
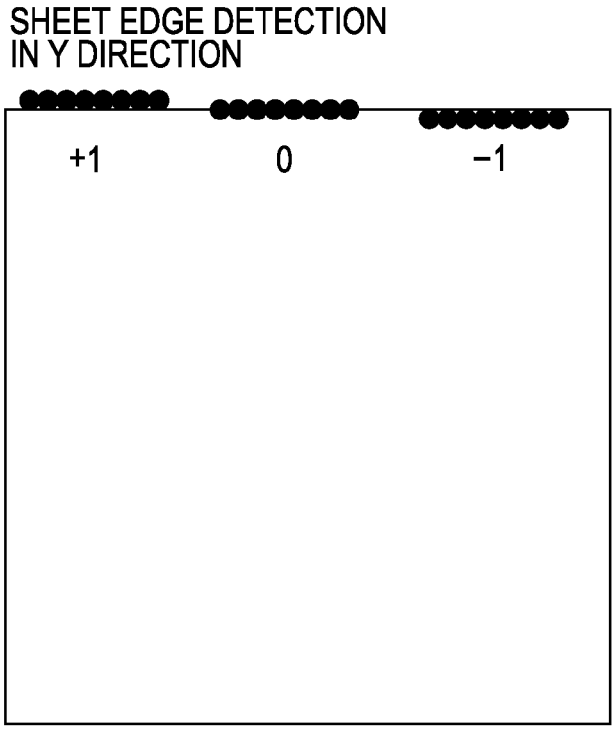
FIG. 23 is a diagram illustrating the positional relation between a recording medium and a Y registration adjustment pattern according to an embodiment of the present invention.

Next, description will be made regarding patterns for detecting the position of a recording medium and the position in the sub-scanning direction of an ink discharge nozzle row with reference to FIG. 23. With the level +1 which forms ink dots straddling from the outside to the inside of a recording medium, ink dots are not formed on a recording medium, and accordingly, the level +1 is not selected. Next, with the level −1, space is formed between ink dots and the end portion of a recording medium.

Accordingly, dots in the level 0 can be selected. The positions of the end portion of a recording medium and ink discharge nozzles are detected with this pattern, and offset is determined as to the reference nozzle of the ink discharge nozzle rows. This offset value may be determined as to each reference nozzle of the respective ink discharge nozzle rows, or may be determined as to a tentative reference nozzle of the ink discharge nozzle rows and ink-jet recording head.

Figure 24:
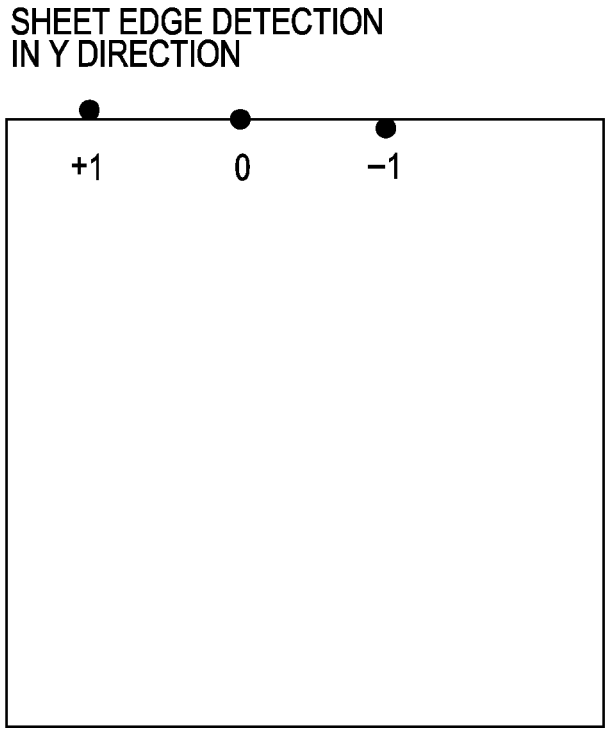
FIG. 24 is a second diagram illustrating the positional relation between a recording medium and a Y registration adjustment pattern according to an embodiment of the present invention.
Figure 25:
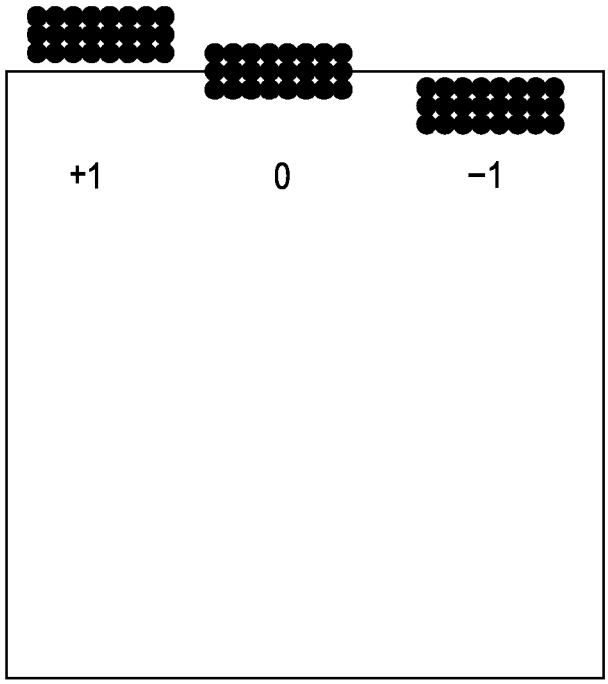
FIG. 25 is a third diagram illustrating the positional relation between a recording medium and a Y registration adjustment pattern according to an embodiment of the present invention.

The mode in FIG. 24 may be employed, or the mode in FIG. 25 may be employed.

With the above recording medium and Y registration adjustment, the ink discharge nozzles to be employed may be all of the general ink discharge nozzles, or may be all of the nozzles excluding the outermost ink discharge nozzles. Also, nozzles which are continuous two dots or more may be employed. Further, nozzles which are discontinuous two dots or more may be employed. Also, a continuous nozzle group may be both ends, or may be a middle portion. Also, with the above recording medium and Y registration adjustment pattern, the ink discharge nozzles having the same driving block and the same driving sequence within the ink discharge nozzle rows A and B may be corresponded to each other. For example, in FIGS. 23, 24, and 25, let us say that the nozzles Nos. 1 and 10 having the same position in the horizontal direction are set to the same driving block, and the nozzles Nos. 2 and 11 are set to the same driving block, and the nozzles Nos. 3 and 12 are set to the same driving block. The positional deviation of the ink dots by the driving sequence of the ink discharge nozzles can be eliminated by employing this configuration. Also, with the above embodiment, the nozzles Nos. 1 and 12, which are the outermost nozzles, are employed, but with the outermost portions of the ink discharge nozzle rows, ink discharge malfunction such as ink color mixture, ink non-discharge, or the like readily occurs as to the other nozzles, and accordingly, the nozzles Nos. 2 through 4 and Nos. 9 through 11 may be employed.

Figure 26:
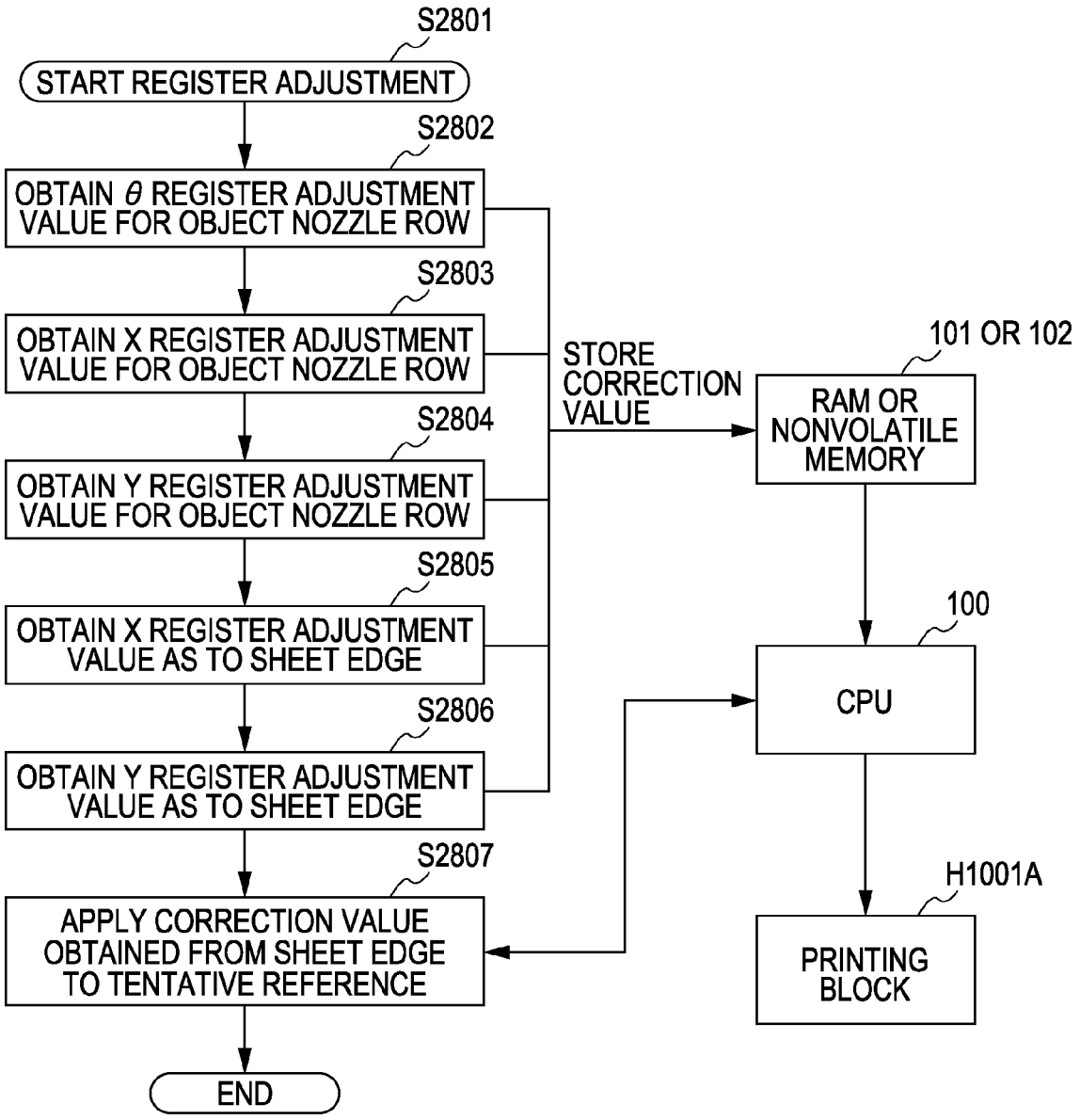
FIG. 26 is a flowchart illustrating a registration adjustment process according to an embodiment of the present invention.

Description will be made regarding a flow for determining an offset value to be obtained from a registration adjustment pattern to perform printing with reference to FIG. 26. A registration adjustment process starts in step S2801. In step S2802, the respective ink discharge nozzle rows are subjected to θ correction. Next, in step S2803, between ink discharge nozzle rows or between ink-jet recording heads are subjected to X correction. Next, in step S2804, between ink discharge nozzle rows or between ink-jet recording heads are subjected to Y correction. Next, the end portion of a recording medium and the position in the main-scanning direction of an ink discharge nozzle row are detected in step S2805, and the end portion of a recording medium and the position in the sub-scanning direction of an ink discharge nozzle row are detected in step S2806. The ROM 101 or RAM 102 serving as a storage unit to store all of these information, the CPU 100 subjects the reference nozzle to correction of the relative positions as to all of θ, X, Y, and a recording medium (S2807), and subjects input print data to correction, and then conveys this to the printing block H1001A to perform printing.

Recognition of the above-described adjustment patterns may be performed by having a user select the amount of each shift from a print result, or may be performed by selecting using scanning by an optical sensor (not shown in the drawing) included in the ink-jet recording device.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application Nos. 2005-199971 filed Jul. 8, 2005, and 2006-179817 filed Jun. 29, 2006, which are hereby incorporated by reference herein in their entirety.

What is claimed is:

1. An ink-jet recording device, which drives an ink-jet recording head mounted on a carriage and including multiple nozzles, while main-scanning by moving the carriage in a direction generally orthogonal to a sheet-feeding direction of a sheet, so as to record on the sheet, the ink-jet recording device comprising:

a dot pattern recording unit configured to form a first dot pattern of a predetermined size in a main-scanning direction, with predetermined intervals, by driving a predetermined number of nozzles located at one end portion of the recording head, and to form a second dot pattern of the predetermined size in the main-scanning direction, with the predetermined intervals, by driving a predetermined number of nozzles located at the other end portion of the recording head, and the first dot pattern and the second dot pattern are formed alternately in the main-scanning direction, wherein a sheet-feeding is performed, after the first dot pattern has been formed and before forming the second dot pattern, such that the predetermined number of nozzles located at the other end portion of the recording head face the first dot pattern.

2. The ink-jet recording device according to claim 1, wherein the first and second dot patterns are recorded using at least two or more nozzles around an end portion of a nozzle row.

3. The ink-jet recording device according to claim 1, wherein the first and second recording units record the first and second dot patterns using nozzles excluding nozzles at both end portions of a nozzle row.

4. The ink-jet recording device according to claim 1, wherein the first dot pattern and the second dot pattern are recorded by scanning the carriage in the same direction.

5. The ink-jet recording device according to claim 1, wherein the first dot pattern and the second dot pattern are recorded by shifting in the main-scanning direction in stages.

6. The ink-jet recording device according to claim 1, wherein the first dot pattern and the second dot pattern are formed alternatively in the main-scanning direction such that a leaning of the recording head is detectable based on an image formed in the first and second dot patterns.

7. The ink-jet recording device according to claim 6, wherein the image formed in the first and second dot patterns for detecting the leaning of the recording head comprises a white stripe formed in the first and second dot patterns.

8. The ink-jet recording device according to claim 6, wherein the image formed in the first and second dot patterns for detecting the leaning of the recording head comprises a black stripe formed in the first and second dot patterns.

9. A dot pattern recording method, for driving an ink-jet recording head mounted on a carriage and including multiple nozzles, while main-scanning by moving the carriage in a direction generally orthogonal to a sheet-feeding direction of a sheet by sheet feeding unit, so as to record on the sheet, the method comprising:

forming a first dot pattern of a predetermined size in a main-scanning direction, with predetermined intervals, by driving a predetermined number of nozzles located at one end portion of the recording head;

performing a sheet feeding, after the first dot pattern has been formed and before forming a second dot pattern, such that the predetermined number of nozzles located at the other end portion of the recording head face the first dot pattern; and forming the second dot pattern of the predetermined size in the main-scanning direction, with the predetermined intervals, by driving a predetermined number of nozzles located at the other end portion of the recording head, wherein the first dot pattern and the second dot pattern are formed alternately in the main-scanning direction.

10. The method according to claim 9, wherein the first and second dot patterns are recorded using at least two or more nozzles around an end portion of a nozzle row.

11. The method according to claim 9, wherein the first and second dot patterns are recorded using nozzles excluding nozzles at both end portions of a nozzle row.

12. The method according to claim 9, wherein the first dot pattern and the second dot pattern are recorded by scanning the carriage in the same direction.

13. The method according to claim 9, wherein the first dot pattern and the second dot pattern are recorded by shifting in the main-scanning direction in stages.

14. The method according to claim 9, further comprising:

detecting a leaning of the recording head based on an image formed in the first and second dot patterns.

15. The method according to claim 14, wherein the image formed in the first and second dot patterns for detecting the leaning of the recording head comprises a white stripe formed in the first and second dot patterns.

16. The method according to claim 14, wherein the image formed in the first and second dot patterns for detecting the leaning of the recording head comprises a black stripe formed in the first and second dot patterns.

17. An ink-jet recording device, which drives an ink-jet recording head mounted on a carriage and including multiple nozzles, while main-scanning by moving the carriage in a direction generally orthogonal to a sheet-feeding direction of a sheet, so as to record on the sheet, the ink-jet recording device comprising:

printing control means for driving a first nozzle at an upstream side in the sheet-feeding direction of the sheet to form a first dot pattern while scanning the carriage and driving a second nozzle at a downstream side in the sheet-feeding direction of the sheet to form a second dot pattern; and a sheet-feeding unit configured to feed a region where the first dot pattern is recorded to a position facing the second nozzle;

wherein the first dot pattern and the second dot pattern are recorded alternately in the main-scanning direction.

18. The ink-jet recording device according to claim 17, wherein a leaning of the recording head is detectable based on an image formed in the first and second dot patterns.

19. The ink-jet recording device according to claim 18, wherein the image formed in the first and second dot patterns for detecting the leaning of the recording head comprises a white stripe formed in the first and second dot patterns.

20. The ink-jet recording device according to claim 18, wherein the image formed in the first and second dot patterns for detecting the leaning of the recording head comprises a black stripe formed in the first and second dot patterns.

* * * * *